US008229319B2

(12) United States Patent
Tomatsu et al.

(10) Patent No.: US 8,229,319 B2
(45) Date of Patent: Jul. 24, 2012

(54) IMAGE FORMING APPARATUS INCLUDING DETACHABLE SUPPORTING MEMBER

(75) Inventors: Yoshiya Tomatsu, Kasugai (JP); Yoji Tsujishita, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 197 days.

(21) Appl. No.: 12/769,094

(22) Filed: Apr. 28, 2010

(65) Prior Publication Data

US 2010/0272468 A1 Oct. 28, 2010

(30) Foreign Application Priority Data

Apr. 28, 2009 (JP) ..... 2009-109385

(51) Int. Cl.
*G03G 15/00* (2006.01)
*G03G 21/16* (2006.01)

(52) U.S. Cl. ..... 399/110; 399/111

(58) Field of Classification Search ..... 399/110, 399/111, 112

See application file for complete search history.

(56) References Cited

U.S. PATENT DOCUMENTS

| | | | | |
|---|---|---|---|---|
| 7,778,567 | B2 * | 8/2010 | Igarashi et al. | 399/110 |
| 2007/0053716 | A1 | 3/2007 | Itabashi | |
| 2007/0071494 | A1 * | 3/2007 | Igarashi et al. | 399/110 |
| 2009/0016771 | A1 | 1/2009 | Hashimoto | |

FOREIGN PATENT DOCUMENTS

| | | |
|---|---|---|
| JP | 05-257340 | 10/1993 |
| JP | 10-221911 | 8/1998 |
| JP | 2004-109886 | 4/2004 |
| JP | 2004-145076 | 5/2004 |
| JP | 2004-264688 | 9/2004 |
| JP | 2005-107413 | 4/2005 |
| JP | 2005-338180 | 12/2005 |
| JP | 2007-065559 | 3/2007 |
| JP | 2009-020406 | 1/2009 |

* cited by examiner

*Primary Examiner* — Sophia S Chen
(74) *Attorney, Agent, or Firm* — Banner & Witcoff, Ltd.

(57) ABSTRACT

An apparatus includes: a main body; a supporting member having a first side wall and a second side wall, the supporting member configured to be movable between an accommodation position and a withdrawn position, the supporting member configured to be removable from the apparatus main body by being withdrawn further from the withdrawn position; a first frame facing the first side wall and a second frame facing the second side wall; a lock member configured to be movable between a lock position and a release position; and a restriction unit provided on the second side wall and the second frame, the restriction unit configured to restrict a rotation of the supporting member by coming contact with the supporting member when the supporting member, which is locked into the withdrawn position, rotates to the first frame side of the apparatus main body.

26 Claims, 19 Drawing Sheets

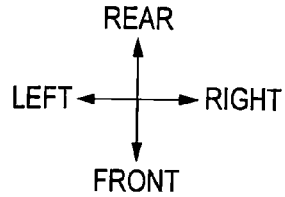
FIG. 7A
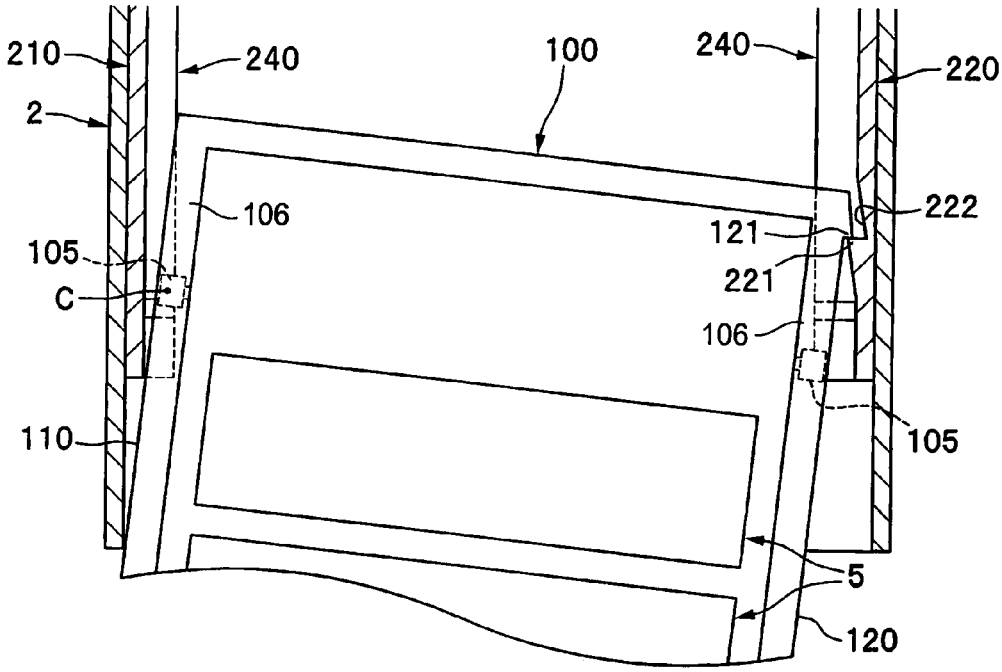
FIG. 7B
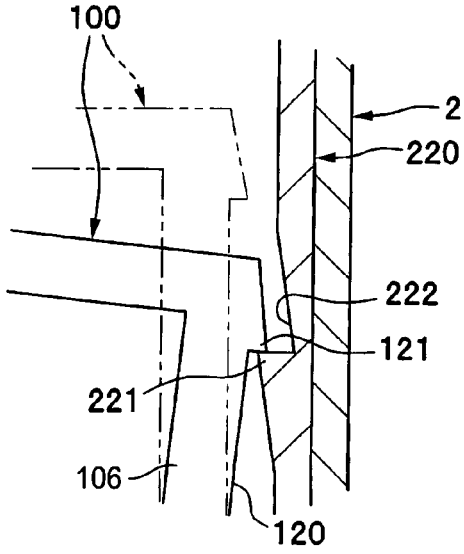

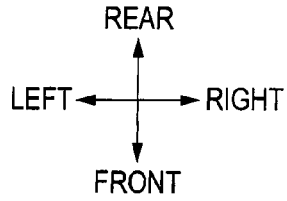
FIG. 9A
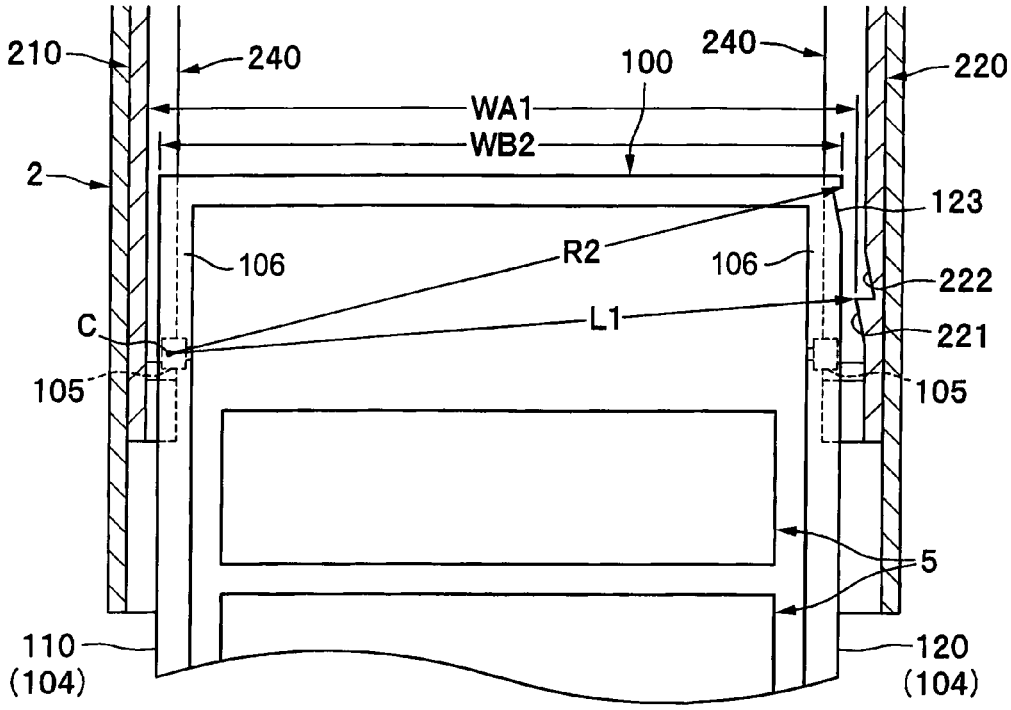
FIG. 9B
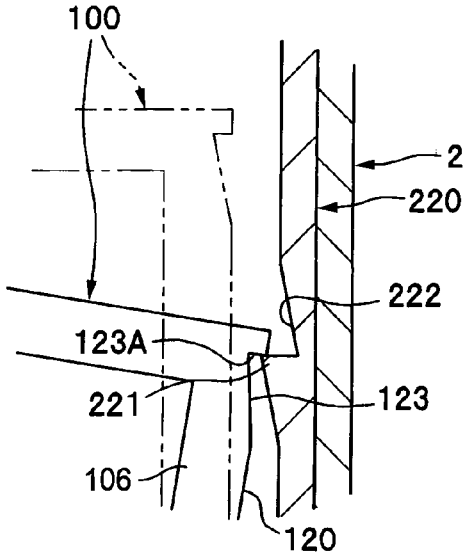

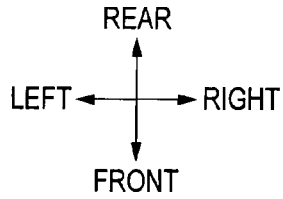
FIG. 10A
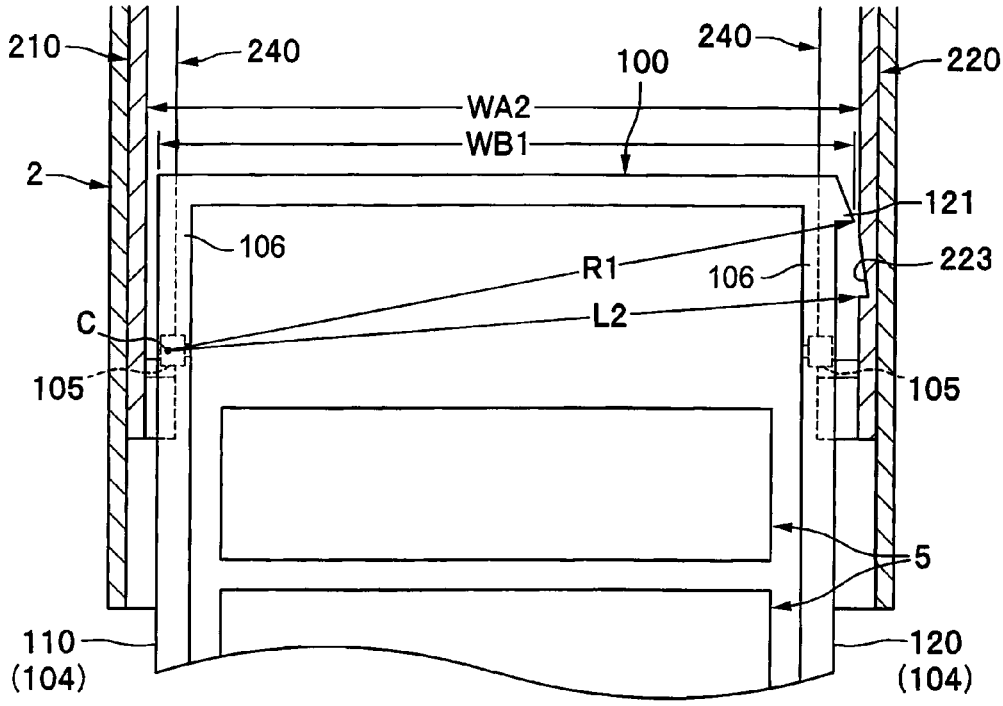
FIG. 10B
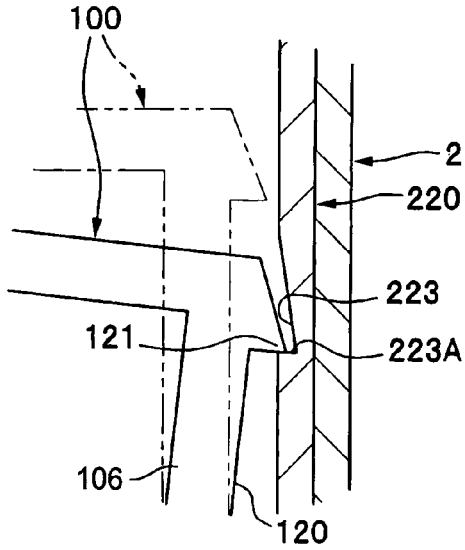

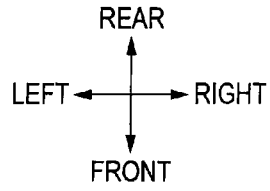
FIG. 11A
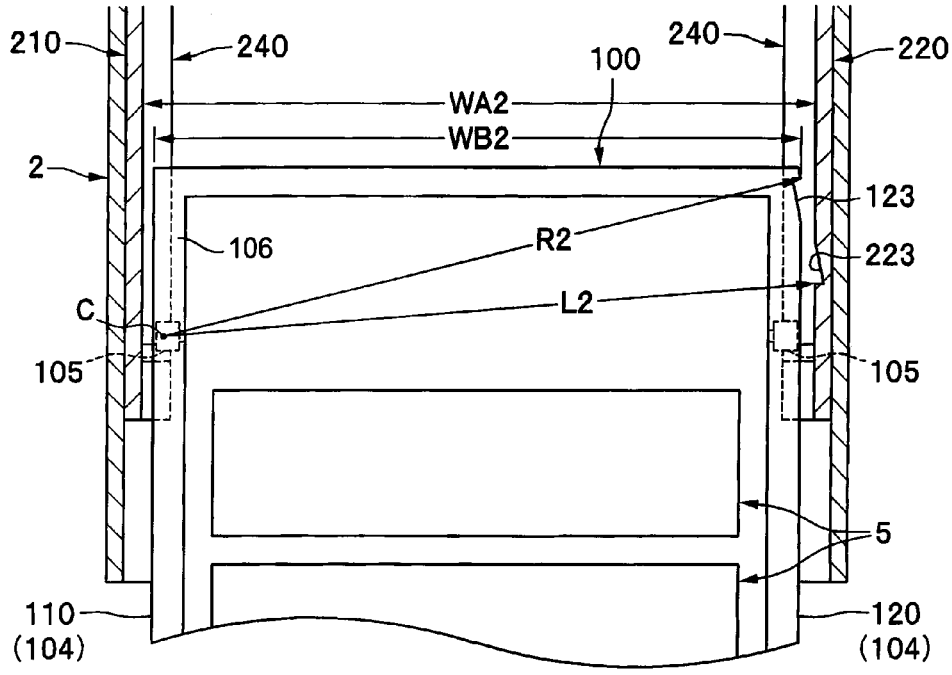
FIG. 11B
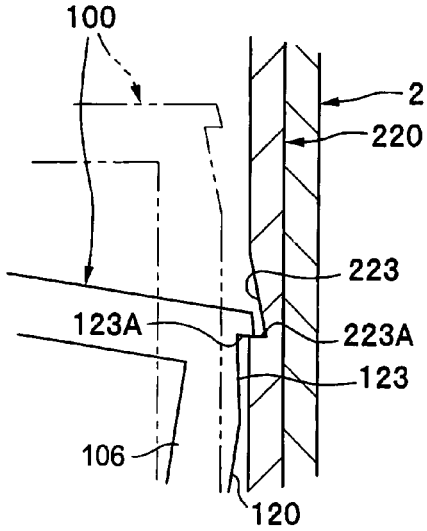

IMAGE FORMING APPARATUS INCLUDING DETACHABLE SUPPORTING MEMBER

CROSS REFERENCE TO RELATED APPLICATION

The present application claims priority from Japanese Patent Application No. 2009-109385, which was filed on Apr. 28, 2009, the disclosure of which is herein incorporated by reference in its entirety.

TECHNICAL FIELD

The apparatuses and devices consistent with the present invention relate to an image forming apparatus that includes a supporting member configured to be withdrawn and removed from an apparatus main body.

BACKGROUND

In general, there is a related art image forming apparatus in which a supporting member (drawer case) that arranges and accommodates a process cartridge or cartridges can be withdrawn and removed from the apparatus main body. According to this structure, it is possible to easily handle paper jams when they occur and exchange process cartridges by removing the supporting member.

However, the exchange of the process cartridge can be performed even in a state in which the supporting member is withdrawn from the apparatus main body. Thus, a lock member for restricting the removal of the supporting member is provided on the supporting member or the apparatus main body so that the supporting member may not be removed and dropped during the exchanging operation. According to the related art, the lock member is provided on both sides of the supporting member one by one.

SUMMARY

However, if the lock member is provided on both sides of the supporting member, when the locks are released, it is necessary for a user to perform the release operation separately at both sides thereof while supporting the supporting member or it is necessary to configure the lock members of both sides such that the locks of both sides are released by the releasing operation of one side by interlocking the operations of the lock members of both sides. Therefore, when the release operations of the locks are separately performed at each sides side, the operability is low. And, when the lock members of both sides are interlocked, the structure of the apparatus is complicated, which leads to an increase in cost.

In addition, in the structure as described, the supporting member is raised and released from a lock state after the supporting member is withdrawn from the apparatus main body. Thus, when the supporting member is raised while being withdrawn, the lock member will not function properly, and accordingly, the supporting member will be removed and will drop from the apparatus main body.

Thus, an object of the present invention is to provide an image forming apparatus that has a simple structure, and is capable of restricting the supporting member at the withdrawn position and easily performing the release operation of the lock.

And, another object of the present invention is to provide an image forming apparatus that is capable of halting the withdrawing of the supporting member from the apparatus main body so that the supporting member is not removed, and then removing the supporting member.

According to an illustrative aspect of the present invention, there is provided an image forming apparatus comprising: an apparatus main body; a frame-shaped supporting member that has a first side wall and a second side wall that is opposed to the first side wall, the supporting member configured to be movable between an accommodation position where the supporting member is accommodated in the apparatus main body and a withdrawn position where the supporting member is withdrawn from the apparatus main body, the supporting member configured to be removable from the apparatus main body by being withdrawn further from the withdrawn position; a first frame that is opposed to the first side wall and a second frame that is opposed to the second side wall, the first frame and the second frame disposed opposite to each other so as to accommodate the supporting member which is in the accommodation position in the apparatus main body, the first frame and the second frame supporting the supporting member so as to be movable between the accommodation position and the withdrawn position; a lock member that is configured to be movable between a lock position at which the first side wall of the supporting member is restricted and locked at the withdrawn position and a release position at which the lock member is released to allow the supporting member to be removed; and a restriction unit that is provided on the second side wall and the second frame, the restriction unit configured to restrict a rotation of the supporting member by coming contact with the supporting member when the supporting member, which is locked into the withdrawn position, rotates to the first frame side of the apparatus main body.

According to the image forming apparatus configured as described above, when the supporting member is withdrawn to the withdrawn position, it is restricted in the withdrawn position by the lock member. At this time, when the supporting member is attempted to be further withdrawn, the supporting member attempts to rotate around the position near the place where the supporting member is restricted by the lock member toward the first frame, this rotation, however, is restricted by restriction unit which is provided in the second side wall and the second frame and come in contact with each other. Thus, it is possible to restrict the supporting member at the withdrawn position by a simple structure having the lock member of one side and the restriction members coming in contact with each other. Furthermore, since the lock member is provided at only one side, it is possible to easily perform the release operation of the lock.

According to another illustrative aspect of the present invention, there is provided an image forming apparatus comprising: an apparatus main body; a frame-shaped supporting member that is configured to be movable between an accommodation position where it is accommodated in the apparatus main body and a withdrawn position where it is being withdrawn from the apparatus main body and be removable from the apparatus main body by being withdrawn further from the withdrawn position, the supporting member having a pair of side walls opposing each other so as to extend in the withdrawal direction; a pair of frames that is arranged to oppose the side walls so as to sandwich the supporting member which is in the accommodation position in the apparatus main body and is configured to support the supporting member to be movable between the accommodation position and the withdrawn position; a stopper member that is provided on either one of the frames so as to restrict the supporting member from moving in an extending direction of the withdrawal direction when the supporting member is being withdrawn from the withdrawn position; a lock member that is movable between a lock position where it restricts the supporting member at the withdrawn position so that it is unable to be removed in collaboration with the stopper member and a release position where it releases the lock so that the supporting member can be removed; and a prohibiting unit for prohibiting the lock member from moving from the lock position to the release position when the supporting member is at the accommodation position, wherein, the lock member is movable toward the release position regardless of the prohibiting unit when the supporting member is at the withdrawn position.

According to the image forming apparatus configured as described above, when the supporting member is being withdrawn to the withdrawn position, the movement thereof is restricted by the stopper member, and the stopper member and the lock member move in tandem to restrict the supporting member at the withdrawn position and to lock it cannot be removed. The supporting member can be removed from the apparatus main body by releasing the lock. If the lock member is moved to the release position when the supporting member is withdrawn, although there is a possibility that the supporting member is removed without being restricted at the withdrawn position, it is possible to restrict the supporting member at the withdrawn position by the prohibiting unit which prohibits the lock member from moving to the release position.

BRIEF DESCRIPTION OF THE DRAWINGS

Illustrative aspects of the invention will be described in detail with reference to the following figures wherein:

FIG. 7A is a diagram showing a state in which a supporting case rotates further from a withdrawing state, and FIG. 7B is an enlarged view of FIG. 7A;

FIG. 9A is a cross-sectional view of a second embodiment taken along the line X-X of FIG. 2, and FIG. 9B is an enlarged view showing a state in which a supporting case rotates further from a withdrawing state;

FIG. 10A is a cross-sectional view of a third embodiment taken along the line X-X of FIG. 2, and FIG. 10B is an enlarged view showing a state in which a supporting case rotates further from a withdrawing state;

FIG. 11A is a cross-sectional view of a fourth embodiment taken along the line X-X of FIG. 2, and FIG. 11B is an enlarged view showing a state in which a supporting case rotates further from a withdrawing state;

DETAILED DESCRIPTION OF EXEMPLARY EMBODIMENTS OF THE PRESENT INVENTION

Next, an embodiment of the present invention will be described suitably with reference to the drawings. In addition, in the following description, first, a schematic structure of a color printer 1 as one example of an image forming apparatus will be described, and thereafter structures of a supporting case 100 (supporting member) and therearound will be described.

In addition, in the following description, directions will be described with directions on the basis of a user of the color printer. That is, in FIG. 1, a right side refers to "front", a left side refers to "rear", a front side refers to "left side", and an inner side refers to "right side". In addition, an up-and-down direction in FIG. 1 refers to "up-and-down".

Schematic Structure of Color Printer

Figure 1:
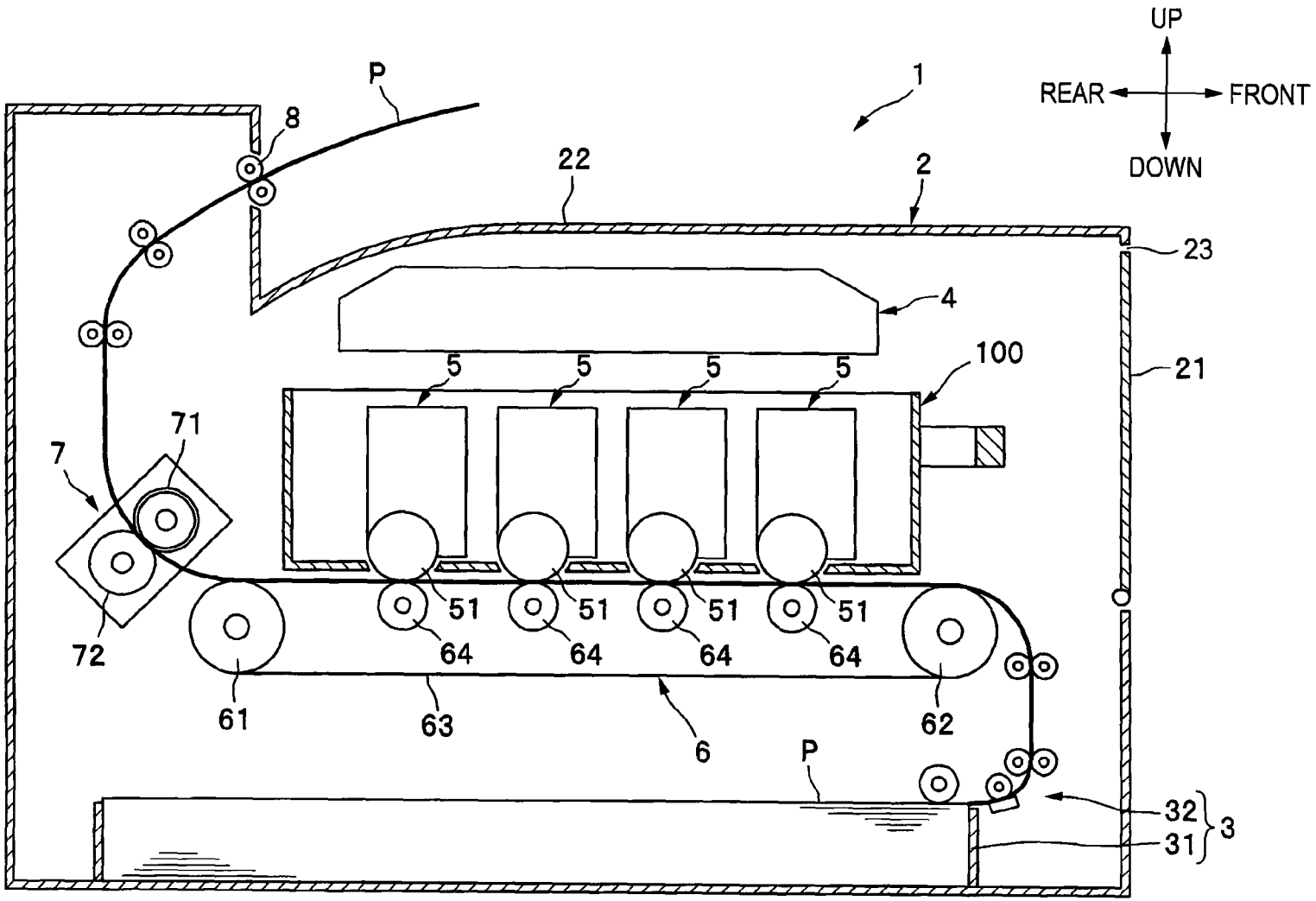
FIG. 1 is a diagram showing a schematic structure of a color printer as one example of an image forming apparatus according to an embodiment of the present invention.

As shown in FIG. 1, the color printer 1 includes, a substantially box-shaped main body housing 2 constituting an outer frame as one example of an apparatus main body, a paper feeding unit 3, a light exposing unit 4, four process cartridges 5, a transfer unit 6 and a fixing unit 7.

On the front face of the main body housing 2, an opening 23 is formed so that the supporting case 100 described later can be withdrawn to the front outer side of the main body housing 2, and a front cover 21 that covers the opening 23 configured to be opened and closed is provided so as to able to be rotate back and forth about a bottom end thereof.

The paper feeding unit 3 is provided at the lower portion in the main body housing 2 and includes a paper feeding tray 31 for accommodating papers P and a paper feeding mechanism 32 for feeding the papers P onto a transport belt 63. The papers P in the paper feeding tray 31 are separately fed one by one by the paper feeding mechanism 32.

The light exposing unit 4 is provided at the upper portion in the main body housing 2 and includes a laser light emitting portion, a polygon mirror, a lens and a reflector. The laser light emitted from the laser light emitting portion is reflected by the polygon mirror and the reflector, passes through the lens and is subjected to a high speed scanning on the surfaces of each photosensitive drum 51.

The process cartridges 5 are arranged and accommodated one after another in the supporting case 100 between the paper feeding unit 3 and the light exposing unit 4, and, in addition to photosensitive drums 51, includes a charger, a development roller, a supplying roller and a toner accommodating portion.

The transfer roller 6 is provided between the paper feeding unit 3 and the process cartridge 5, and includes a driving roller 61, a driven roller 62, an endless shaped transport belt 63 installed lengthily between the driving roller 61 and the driven roller 62, and four transfer rollers 64 disposed opposite to the photosensitive drums 51 via the transport belt 63.

The fixing unit 7 is provided at the rear of the process cartridge 5 and the transfer unit 6, and includes a heating roller 71 and a pressing roller 72 which is disposed opposite to the heating roller 71 and pressurizes the heating roller 71.

In the color printer 1 configured as described above, after the surfaces of the photosensitive drums 51 have been similarly charged by the charger, the surfaces are exposed by the laser light from the light exposing unit 4. Thus, electrostatic latent images are formed on the surfaces of the photosensitive drums 51. In addition, the electrostatic latent images on the photosensitive drums 51 are provided with toners from the development roller, so the electrostatic latent images become visible images and toner images are formed on the photosensitive drums 51.

Thereafter, the papers P supplied on the transfer belt 63 are transported between the photosensitive drums 51 and the transport belt 63 (transfer roller 64). Thus, the toner images on each of the photosensitive drums 51 are transferred onto the papers P in a successively overlapped manner. Furthermore, the papers P are transported between the heating roller 71 and the pressing roller 72, so the toner images transferred on the papers P are heat-fixed. The papers P on which the toner images have been heat-fixed are discharged onto the paper discharging tray 22 by means of the discharging roller 8.

Detailed Structure of Color Printer

Figure 2:
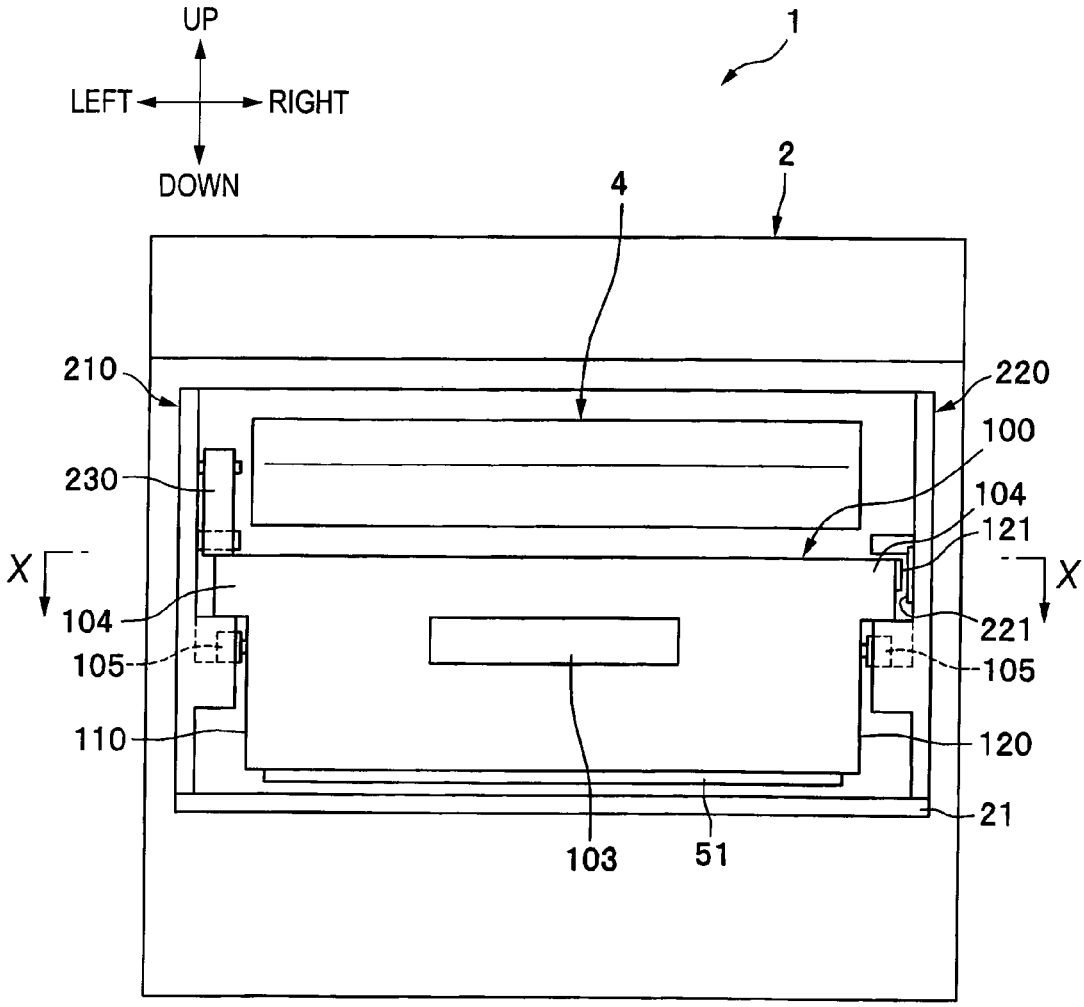
FIG. 2 is a front view of the color printer with a front cover opened.

As shown in FIG. 2, the color printer 1 further includes a supporting case 100 as one example of the supporting member accommodated in the main body housing 2, and a left frame 210 (first frame), a right frame 220 (second frame) and a lock member 230 which are installed in the main body housing 2.

Structures of Left Frame and Right Frame

The left frame 210 and the right frame 220 are plate-like frames which extend in the up and down direction and the front and rear direction, and are disposed opposite each other in the horizontal (left and right) direction with a gap therebetween so as to sandwich the supporting case 100 in the accommodation position in the main body housing 2. More specifically, the left frame 210 faces the left side wall 110 of the supporting case 100, and the right frame 220 faces the right side wall 120 of the supporting case 100.

As shown in FIGS. 5A and 5B and FIGS. 6A and 6B, each of the opposing surfaces of the left frame 210 and the right frame 220 is provided with a guide rail 240 that protrudes toward the inner side in the left and right direction and extends horizontally in the front and rear direction, and an engaging protrusion 250 that protrudes and extends substantially in parallel to the guide rail 240 at a position above the guide rail 240 such that there is a gap.

The upper surface of each of the guide rails 240 is provided with a guide surface 241 that extends substantially horizontally and a stopper member 243 that is disposed close to a front end of the guide surface 241 so as to protrude further upward than the guide surface 241. The rear surface of each of the stopper members 243 is configured as an inclined surface 242 that extends obliquely forward and upward from the guide surface 241. In addition, an abutting portion 244 that protrudes upward is formed at the rear end of each of the guide surfaces 241.

The stopper members 243 of the present embodiment are configured such that supporting protrusions 104 described later are slidably mounted on upper surfaces thereof. However, the stopper members 243 may be configured as roller-like members so that the supporting protrusions 104 are mounted thereon.

Structure of Supporting Case

The supporting case 100 is configured so that it can be moved back and forth between an accommodation position (see FIG. 1) where the supporting case 100 is accommodated in the main body housing 2 and a withdrawn position (see FIGS. 5B and 6B) where the supporting case 100 is withdrawn from the main body housing. In addition, the supporting case 100 is configured so that after the lock by the lock member 230 has been released, by being withdrawn further forward from the withdrawn position, it can be removed from the main body housing 2 (see FIG. 8).

Figure 3:
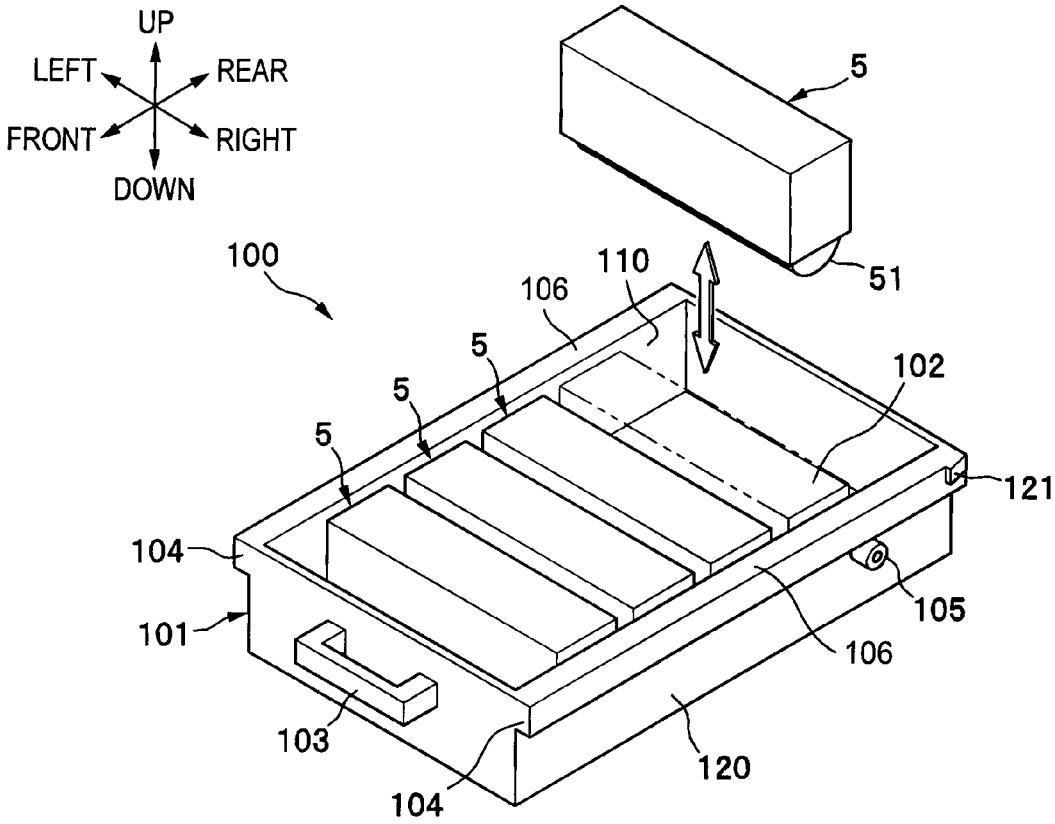
FIG. 3 is a perspective view of a supporting case.

As shown in FIG. 3, the supporting case 100 is constituted by a peripheral wall portion 101 with a rectangular frame shape when viewed in a plane and a bottom wall portion 102 in an upper-part opened box shape, so that the process cartridge 5 is accommodated in an exchangeable (removable) manner. On the bottom wall portion 102, an opening (not shown) for exposing the lower portion of the photosensitive drum 51 is formed.

The peripheral wall portion 101 has a left side wall 110 (first side wall) and a right side wall 120 (second side wall) which extend along the withdrawn direction (front and rear direction) and are opposed to each other. In addition, at the front surface of the peripheral wall portion 101, there is installed a handle 103 with a substantially U-shaped when viewed in the plane which is gripped by the user when the supporting case 100 is withdrawn or removed.

The supporting protrusions 104 that protrude like a flange toward the outer side in the left and right direction and extend in the front and rear direction are provided on the upper portions of the left side wall 110 and the right side wall 120. Moreover, contact portions, namely guide rollers 105 (only the right-side one is shown) that come in contact with the guide rails 240, are provided on the lower side close to the rear end of the supporting protrusions 104. The contact members 105 may be configured as sled-like members that slide on the guide rails 240 instead of the roller-like members that roll on the guide rails 240.

When the supporting case 100 is drawn forward and pushed backward, the guide rollers 105 roll on the guide surfaces 241, and the supporting case 100 moves back and forth between the accommodation position and the withdrawn position. At this time, the supporting protrusions 104 of the supporting case 100 slide on the upper surfaces of the stopper members 243. Herein, in the present embodiment, the accommodation position refers to a position at which the guide rollers 105 come in contact with the front surfaces of the contact portions 244, and the supporting case 100 is accommodated in the main body housing 2, so that printing can be performed with the photosensitive drums 51 facing the transfer rollers 64. In addition, the withdrawn position refers to a position at which the guide rollers 105 come in contact with the inclined surfaces 242 of the stopper members 243, and the forward movement of the supporting case 100 is restricted. When the supporting case 100 is at the withdrawn position, the process cartridge 5 on the supporting case 100 is exposed to the outside from the opening 23 of the main body housing 2, and the process cartridge 5 can be mounted on or detached from the supporting case 100.

The supporting case 100 has portions 106 that extend toward the inner side of the main body housing 2 more than the stopper members 243 when it is at the withdrawn position (in other words, the portions 106 extend further backward than the guide rollers 105). That is to say, the supporting case 100 is inclined to be lowered forward by its own weight when it is at the withdrawn position where the forward movement thereof is restricted by the stopper members 243. However, since the inward extension portions 106 extend toward the inner side of the main body housing 2 more than the stopper members 243, it is possible to support the supporting case 100 to be substantially horizontal (however, it may be inclined so as to fall slightly forward) against the weight thereof by the inward extension portions 106 which come in contact with the engaging protrusions 250.

The inward extension portions 106 only need to be formed so as to extend from at least the supporting protrusions 104 of the side walls 110 and 120. In addition, the engaging protrusions 250 only need to be formed in the vicinity of the ends of at least the guide rails 240 close to the stopper members 243.

A distance LB between the front end of each of the engaging protrusions 250 and each of the stopper members 243 is large enough so that when the supporting case 100 is inclined so that the side of the handle 103 is raised, the supporting protrusion 104 and the guide roller 105 (whose combined height is LC) can pass through a space defined therebetween.

Structure of Lock Member

Figure 5A:
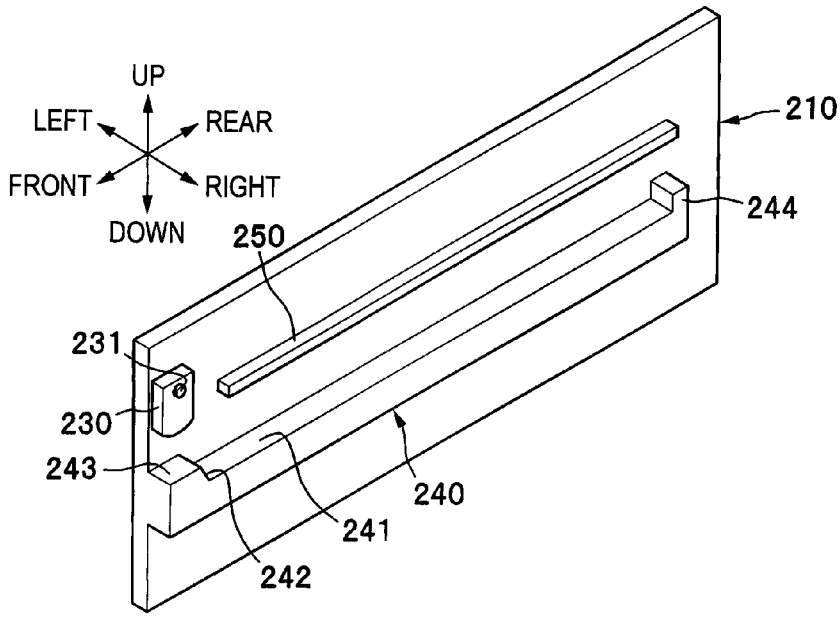
FIG. 5A is a perspective view of a left frame when viewed from the inner side.
Figure 5B:
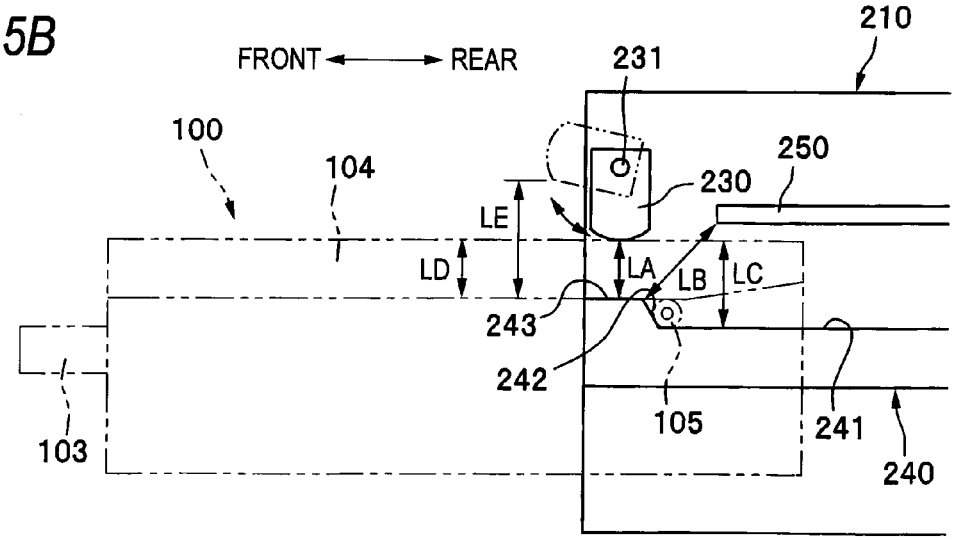
FIG. 5B is a side view of a left frame when viewed from the inner side.

As shown in FIGS. 5A and 5B, the lock member 230 is provided on the inner surface of the left frame 210 above the stopper member 243 with a gap therebetween and configured to be pivotable back and forth about a pivot shaft 231 at an upper part thereof. More specifically, when the lock member 230 is pivoted back and forth about the rotation shaft 231, a lower end thereof is advanced or retracted from the upper surface of the supporting protrusion 104. When the lock member 230 is at the former advanced position, a distance LA between the lower end of the lock member 230 and the upper surface of the stopper member 243 corresponds to approximately a height dimension LD in the vertical direction of the supporting protrusion 104, the supporting protrusion 104 only can pass through the distance LA, and the distance LA has such a dimension that does not allow the supporting protrusion 104 and the guide roller 105 (whose combined height is LC) to pass through a space defined therebetween. In addition, when the lock member 230 is at the latter retracted position, a distance LE between the lower end of the lock member 230 and the upper surface of the stopper member 243 has such a dimension that allows the supporting protrusion 104 and the guide roller 105 (whose combined height is LC) to pass through a space defined therebetween.

Therefore, when the lock member 230 is at the former position (see the solid line in FIG. 5B), the guide roller 105 is suppressed from moving in the direction of surpassing the stopper member 243, and the supporting case 100 is restricted at the withdrawn position so that it cannot be removed from the main body housing 2 (hereinafter, the former position of the lock member 230 will be referred to as a "lock position"). When the lock member 230 is at the latter position (see the dotted line in FIG. 5B), the guide roller 105 is allowed to surpass the stopper member 243, and the supporting case 100 can be removed from the main body housing 2 (hereinafter, the latter position of the lock member 230 will be referred to as a "release position").

Structure of Restriction Unit

Figure 4:
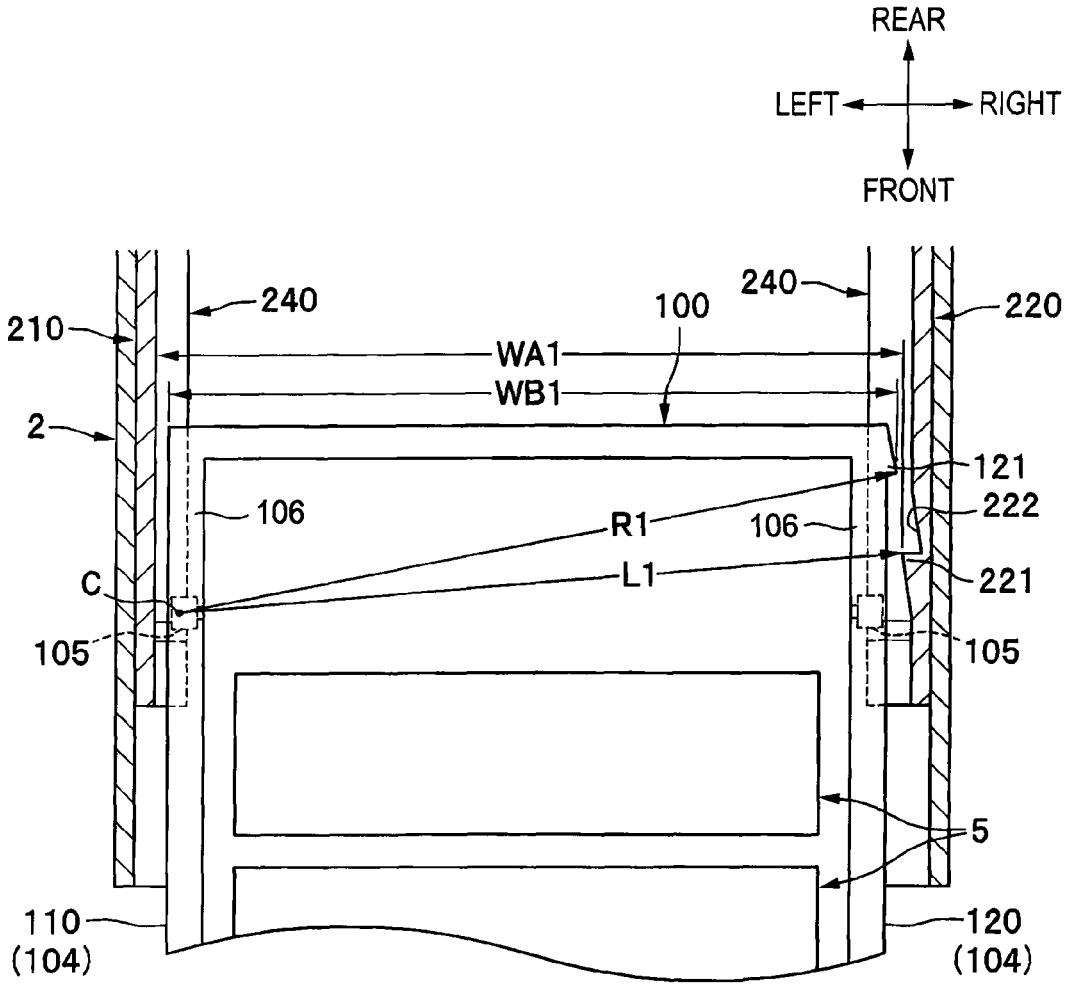
FIG. 4 is a sectional view taken from line X-X of FIG. 2 with the supporting case withdrawn.
Figure 6A:
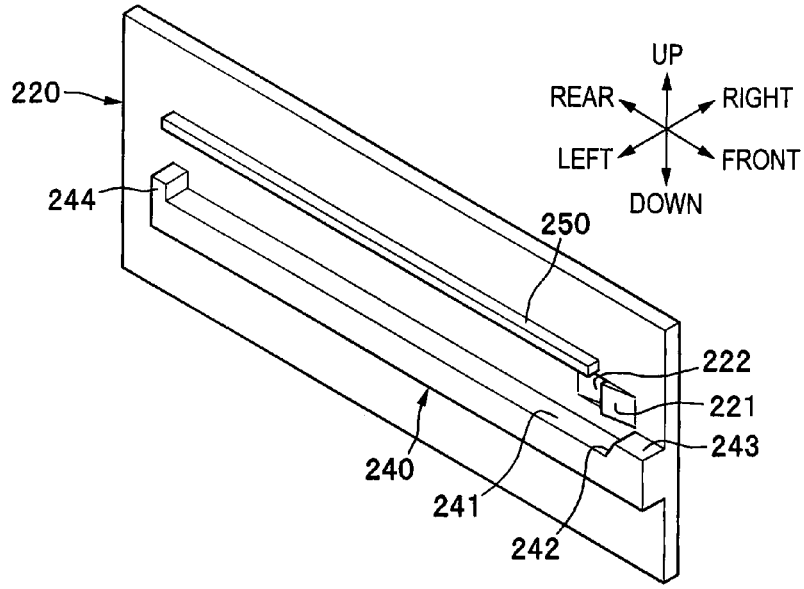
FIG. 6A is a perspective view of a right frame when viewed from the inner side.
Figure 6B:
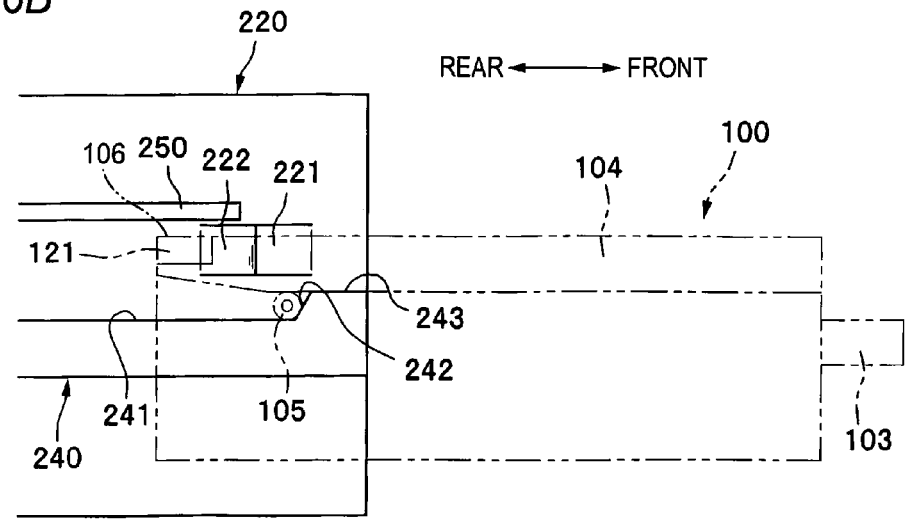
FIG. 6B is a side view of a right frame when viewed from the inner side.

As shown in FIG. 4, an abutting portion 121 is provided on a rear portion of the inward extension portion 106 of the right side wall 120 so as to protrude from the outer side surface of the inward extension portion 106 toward the right frame 220. In addition, as shown in FIG. 4 and FIGS. 6A and 6B, on the inner surface of the right frame 220, an abutted portion 221 that protrudes toward the right side wall 120 of the supporting case 100, and a relief recess 222 that is disposed to be adjacent to an end of the abutted portion 221 at the inner side of the main body housing 2 are provided at positions such that they are located more to the inner side of the main body housing 2 than the stopper member 243 and more to the outer side of the main body housing 2 than the abutting portion 121 when the supporting case 100 is at the withdrawn position. The abutting portion 121 and the abutted portion 221 are also configured to protrude in the direction to cross a circular-arc surface having its center at a rotation center C described later. The abutted portion 221 constitutes a restriction unit (without reference numeral) together with the abutting portion 121 of the supporting case 100.

When the supporting case 100 is further withdrawn in the extending direction of the direction of withdrawing the supporting case 100 from the state (withdrawn position) in which the guide roller 105 comes in contact with the stopper member 243, the supporting case 100 attempts to rotate, in the direction (i.e., clockwise direction in FIG. 4) where the right side wall 120 comes further out toward the front side of the main body housing 2 than the left side wall 110, about a position near the abutting portion where the guide roller 105 whose upward movement is restricted by the lock member 230 comes in contact with the stopper member 243 of the left frame 210. In the present embodiment, a gap is formed between the right side wall 120 and the right frame 220 so that such a rotation is allowed. In addition, a distance R1 (rotational radius) from the rotation center C to the apex of the abutting portion 121 of the supporting case 100 is larger than a distance L1 from the rotation center C to the apex of the abutted portion 221 of the right frame 220. Furthermore, a distance WA1 from the apex of the abutted portion 221 to the inner surface of the left frame 210 is equal to or larger than a distance WB1 from the apex of the abutting portion 121 to the outermost surface of the left side wall 110 (the outer side surface of the inward extension portion 106 of the left side wall 110). As a result, when the supporting case 100 rotates in the manner described above in the state where the guide roller 105 and the stopper member 243 come in contact with each other, the abutting portion 121 comes in contact with the abutted portion 221, and the rotation can be restricted. Thus, by moving the lock member 230 to the release position and withdrawing the supporting case 100 in a straight line in the front and rear direction, it is possible to remove the supporting case 100 from the main body housing 2 while preventing the abutting portion 121 and the abutted portion 221 from interfering with each other.

Operations when Supporting Case is Withdrawn and Removed

Thereafter, the description will be given to the operation when the supporting case 100 is withdrawn from the accommodation position to the withdrawn position and removed from the main body housing 2.

Figure 8:
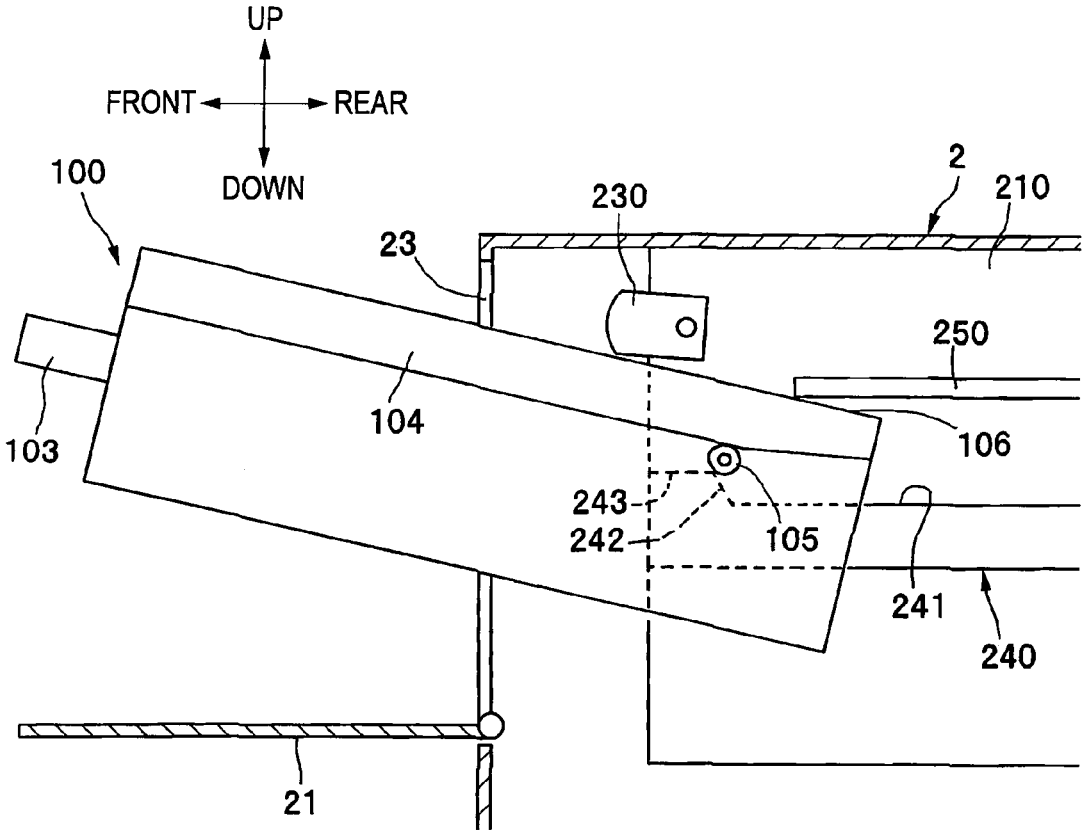
FIG. 8 is a side view showing a condition in which a supporting case is removed from a main body housing.

When the supporting case 100 is being withdrawn from the accommodation position to the withdrawn position, the user opens the front cover 21 (see FIG. 8). Subsequently, when the user draws the handle 103 forward, the guide rollers 105 roll on the guide rails 240 (guide surfaces 241) of the frames 210 and 220, the engaging protrusions 250 slide on the stopper members 243, and the supporting case 100 moves forward from the accommodation position.

As shown in FIG. 5B, when the supporting case 100 is being withdrawn and the guide rollers 105 come in contact with the stopper members 243, the upward movement of the upper surface of the left side wall 110 (the supporting protrusion 104 thereof) is restricted by the lower end of the lock member 230, so that the supporting case 100 is locked at the withdrawn position. In this position, the inward extension portions 106 come in contact with the engaging protrusions 250 due to the weight of the supporting case 100, and the supporting case 100 is held substantially horizontally. Thus, it is possible to exchange the process cartridge 5 to/from the supporting case 100.

In addition, in this state, when the user attempts to withdraw the supporting case 100 further forward (the extending direction of the withdrawal direction), since the supporting case 100 is in the state where only the left side wall 110 is locked at the withdrawn position by the lock member 230, the front side of the right side wall 120 attempts to rotate in the clockwise direction shown in FIG. 4 about the rotation center C near the abutting portion where the guide roller 105 of the left side wall 110 comes in contact with the stopper member 243 of the left frame 210.

During the rotation, the guide roller 105 of the right side wall rides on the stopper member 243. However, the abutted portion 221 of the right frame 220 is positioned so as to interfere with the rotational trajectory of the abutting portion 121 of the supporting case 100 as described above. Thus, as shown in FIGS. 7A and 7B, the abutting portion 121 comes in contact with the abutted portion 221 in the withdrawal direction, so that the movement of the supporting case 100 toward the left frame 210 is restricted, and the supporting case 100 cannot be removed from the withdrawn position to the outside of the main body housing 2.

In addition, since the relief recess 222 is provided at the rear side of the abutted portion 221 of the right frame 220, even when the rotating supporting case 100 is deviated to the right side due to rattling, the abutting portion 121 which is a part of the supporting case 100 can be received in the relief recess 222. In addition, it is possible to suppress the occurrence of noise and scratches resulting from the abutting portion 121 (the supporting case 100) colliding against the inner surface of the right frame 220. The relief recess 222 may be a penetration hole rather than a bottomed recess.

As shown in FIG. 8, when the supporting case 100 is removed from the main body housing 2, the user slides the lock member 230 to the release position to release the lock. Subsequently, the user straightens the supporting case 100, that is, makes the left and right side walls 110 and 120 substantially parallel to the left and right frames 210 and 220 (see the state shown in FIG. 4). In this state, the user draws the handle 103 obliquely upward while taking the supporting case 100 slightly to the left side so that the abutting portion 121 and the abutted portion 221 do not interfere with each other.

As a result, when the guide rollers 105 roll on the inclined surfaces 242 and surpass the stopper members 243 in the state where the supporting case 100 is inclined with the side of the handle 103 raised, the supporting case 100 can be removed from the main body housing 2. In this state, since the upper surface of the transport belt 63 is open, it is possible to remove jammed paper through the open upper surface of the transport belt 63.

When the supporting case 100 is mounted in the main body housing 2, in a state where the lock member 230 is moved to the release position and the supporting case 100 is inclined with the side of the handle 103 raised, the guide rollers 105 are moved to surpass the stopper members 243, and the supporting case 100 is returned to be substantially horizontal and pushed into the main body housing 2. The lock member 230 is returned to the lock position at any time after the supporting case 100 is returned to be substantially horizontal.

According to the color printer 1 of the present embodiment, it is possible to restrict the supporting case 100 at the withdrawn position by a simple structure including the lock member 230 provided at one side and the restriction units (the abutting portion 121 and the abutted portion 221) coming in contact with each other. In addition, since the lock member 230 is provided at only one side (the left side wall 110), the structure of the lock is simple and the release operation can be performed easily. Furthermore, since the abutting portion 121 and the abutted portion 221 can be formed in a smaller space than when the lock member 230 is provided at the right side wall 120, it is possible to reduce the size of the color printer 1.

In the above-described embodiment, the lock member 230 may be provided on the supporting case 100 so that when the supporting case 100 is being withdrawn to the withdrawn position, the lock member 230 is exposed to a position where it can be operated from the outside of the main body housing 2 to be positioned at the release position.

Second Embodiment

The second embodiment is different from the above-described embodiment (hereinafter referred to as "first embodiment") in terms of the shape of the restriction unit and the other structures are the same. FIGS. 9A and 9B show the restriction unit. In the present embodiment, an engaging recess 123 is provided on the rear portion of the right side wall 120 (the outer side surface of the inward extension portion 106) of the supporting case 100 so as to be recessed in the direction away from the right frame 220 substantially along the circular-arc surface having the center at the rotation center C. A rear side wall 123A of the engaging recess 123 is configured to stand in the direction of crossing the circular-arc surface to form an abutting portion. The shape of the abutted portion 221 is the same as that of the first embodiment.

In addition, a distance R2 (rotational radius) from the rotation center C to the apex of the abutting portion 123A is larger than a distance L1 from the rotation center C to the apex of the abutted portion 221. Therefore, when the supporting case 100 attempts to rotate about the rotation center C, the abutting portion 123A comes in contact with the abutted portion 221 in the withdrawal direction, thus restricting the rotation of the supporting case 100.

Furthermore, similar to the first embodiment, a distance WA1 from the apex of the abutted portion 221 to the inner surface of the left frame 210 is larger than a distance WB2 from the apex of the abutting portion 123A (the outer side surface of the inward extension portion 106 of the right side wall 120) to the outermost surface of the left side wall 110 (the outer side surface of the inward extension portion 106 of the left side wall 110). As a result, by moving the lock member 230 to the release position and withdrawing the supporting case 100 in the direction substantially parallel to the left and right frames 210 and 220, it is possible to remove the supporting case 100 from the main body housing 2.

Third Embodiment

The third embodiment is also different from the first embodiment in terms of the shape of the restriction unit and the other structures are the same. FIGS. 10A and 10B show the restriction unit. In the present embodiment, a restriction recess 223 is provided on the inner surface of the right frame 220 so as to be recessed in the direction away from the right side wall 120 substantially along the circular-arc surface having the center at the rotation center C. A front side wall 223A of the restriction recess 223 is configured to stand in the direction of crossing the circular-arc surface to form an abutted portion. The shape of the abutting portion 121 is the same as that of the first embodiment.

In addition, a distance R1 (rotational radius) from the rotation center C to the apex of the abutting portion 121 is larger than a distance L2 from the rotation center C to an end of the abutted portion 223A close to the right side wall 120. Therefore, when the supporting case 100 attempts to rotate about the rotation center C, the abutting portion 121 comes in contact with the abutted portion 223A in the withdrawal direction, thus restricting the rotation of the supporting case 100.

Furthermore, similar to the first embodiment, a distance WA2 from the inner surface of the left frame 210 to the end of the abutted portion 223A (the inner surface of the right frame 220) is larger than a distance WB1 from the apex of the abutting portion 121 to the outermost surface of the left side wall 110 (the outer side surface of the inward extension portion 106 of the left side wall 110). As a result, by moving the lock member 230 to the release position and withdrawing the supporting case 100 in the direction substantially parallel to the left and right frames 210 and 220, it is possible to remove the supporting case 100 from the main body housing 2.

Fourth Embodiment

The fourth embodiment is different from the first embodiment in terms of the shape of the restriction unit and the other structures are the same. FIGS. 11A and 11B show the restriction unit. In the present embodiment, an engaging recess 123 is provided on the rear portion of the right side wall 120 (the outer side surface of the inward extension portion 106) of the supporting case 100 so as to be recessed in the direction away from the right frame 220 substantially along the circular-arc surface having the center at the rotation center C. A rear side wall 123A of the engaging recess 123 is configured to stand in the direction of crossing the circular-arc surface to form an abutting portion. In addition, a restriction recess 223 is provided on the inner surface of the right frame 220 so as to be recessed in the direction away from the right side wall 120 substantially along the circular-arc surface having the center at the rotation center C. A front side wall 223A of the restriction recess 223 is configured to stand in the direction of crossing the circular-arc surface to form an abutted portion.

In addition, a distance R2 (rotational radius) from the rotation center C to the apex of the abutting portion 123A is larger than a distance L2 from the rotation center C to an end of the abutted portion 223A close to the right side wall 120. Therefore, when the supporting case 100 attempts to rotate about the rotation center C, the abutting portion 123A comes in contact with the abutted portion 223A in the withdrawal direction, thus restricting the rotation of the supporting case 100.

Furthermore, similar to the first embodiment, a distance WA2 from the inner surface of the left frame 210 to the end of the abutted portion 223A (the inner surface of the right frame 220) is larger than a distance WB2 from the apex of the abutting portion 123A (the outer side surface of the inward extension portion 106 of the right side wall 120) to the outermost surface of the left side wall 110 (the outer side surface of the inward extension portion 106 of the left side wall 110). As a result, by moving the lock member 230 to the release position and withdrawing the supporting case 100 in the direction substantially parallel to the left and right frames 210 and 220, it is possible to remove the supporting case 100 from the main body housing 2.

Fifth Embodiment

In the above-described embodiments, the restriction unit is configured to include the abutting portion and the abutted portion which have a certain angle with respect to the inner surface of the right frame 220 or the outer side surface of each of the supporting protrusions 104. However, the rear end of each of the supporting protrusions 104 (the inward extension portions 106) may be configured as the abutting portion, and the inner surface of the right frame 220 may be configured as the abutted portion so that the corner of the rear end of each of the inward extension portions 106 comes in contact with the flat inner surface of the right frame 220. In addition, the abutting portion and the abutted portion may come in contact with each other when the supporting case 100 (supporting member) attempts to rotate.

Sixth Embodiment

FIGS. 12 to 17 show the sixth embodiment which is different from the first embodiment in terms of the supporting case, the lock member, the stopper member, and the like. The same structures as those of the first embodiment will be denoted by the same reference numerals, and description thereof will be omitted.

In the sixth embodiment, a stopper member 245 that is provided on the inner surface of each of the frames 210 and 220 is configured by a cylindrical pin. More specifically, the stopper member 245 is a cylindrical head portion of a male screw that is screwed into each of the frames 210 and 220. In addition, the male screw of the left frame 210 also serves as a means for attaching a supporting plate 232 supporting a lock member 230A described later to the left frame 210. The distance between the stopper member 245 and the engaging protrusion 250 is the same as that in the first embodiment.

The lock member 230A includes a locking portion 234 and an operation portion 235 which are provided on the supporting plate 232. The locking portion 234 is disposed on a side close to a supporting case 100A and supported so as to be pivotable toward and away from the frame 210 about a shaft 233 that is substantially parallel to the withdrawal direction of the supporting case 100A. The operation portion 235 is disposed at the opposite side of the locking portion 234 with the shaft 233 disposed therebetween. When the operation portion 235 is operated toward the opening 23 of the main body housing 2, the locking portion 234 can be moved toward and away from the supporting protrusion 104 between a release position and a lock position which will be described later. The distances between the locking portion 234 and the stopper member 245 at the lock position and the release position are the same as those in the first embodiment. In the present embodiment, the front side of the exposure unit 4 is covered by a cover 260, and the operation portion 235 is exposed to the front surface of the cover 260.

Figure 15:
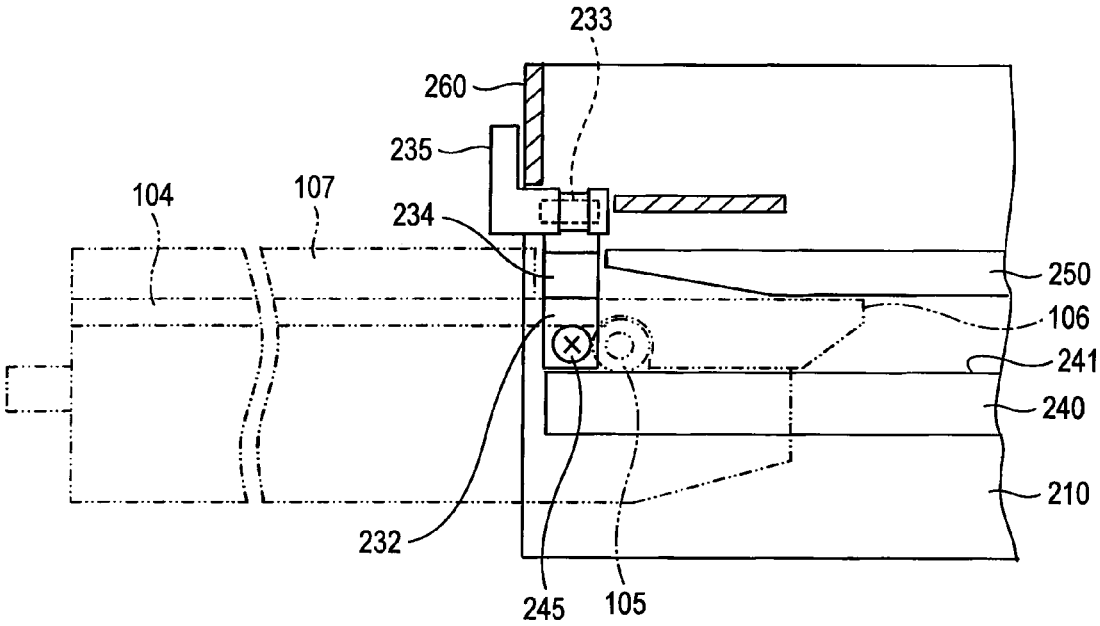
FIG. 15 is a side view of a left frame according to the sixth embodiment as viewed from an inner side.
Figure 16:
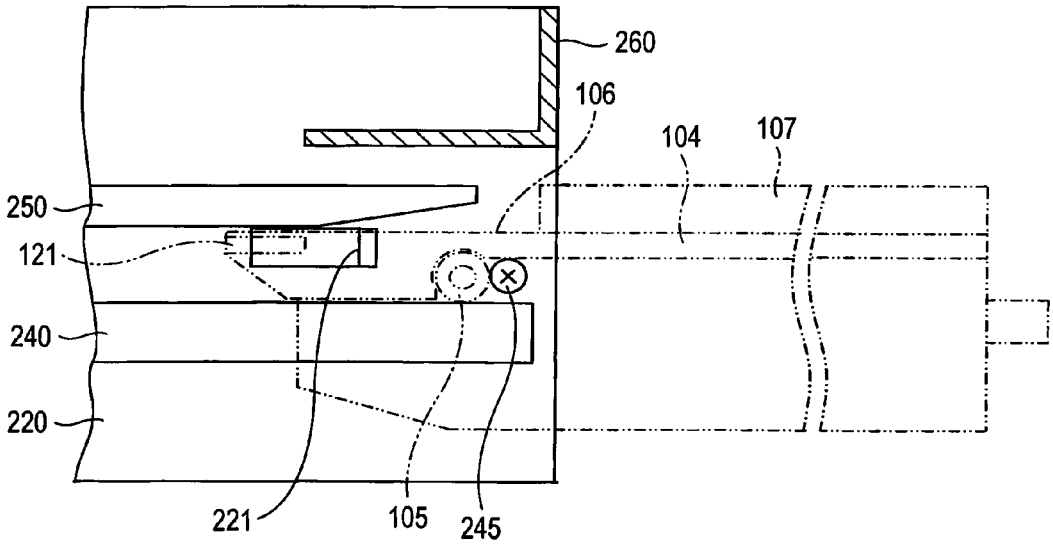
FIG. 16 is a side view of a right frame according to the sixth embodiment as viewed from an inner side.

The supporting case 100A includes a wall 107 which is provided on the upper surface of the supporting protrusion 104 so as to stand substantially in the extending direction of the side walls 110 and 120. The standing wall 107 is positioned more to the inner side than the outer side surface of the supporting protrusion 104 so as to stand in an L-shape with respect to the upper surface of the supporting protrusion 104 and extend long in the withdrawal direction of the supporting case 100A. The length of the standing wall 107 is set such that a front end thereof is positioned to face the lock member 230A when the supporting case 100A is at the accommodation position, and that a rear end thereof is positioned closer to the front side than the lock member 230A when the supporting case 100A is at the withdrawn position as shown in FIG. 15.

In addition, the supporting case 100A includes a handle 103A which is provided on the rear wall of the peripheral wall portion 101 and which is gripped by the user. The inner extension portion 106 includes the abutting portion 121 that extends further backward than the handle 103A so as to protrude from the outer side surface of the rear end of the right inward extension portion 106. The inward extension portion 106 is formed to be higher than the supporting protrusion 104 in the up and down direction and a lower end thereof is positioned to be slightly lower than the lower end of the guide roller 105. As a result, when the removed supporting case 100A is mounted in the main body housing 2, by causing the inward extension portion 106 to be placed on the stopper member 245, the guide roller 105 can easily surpass the stopper member 245.

Figure 12:
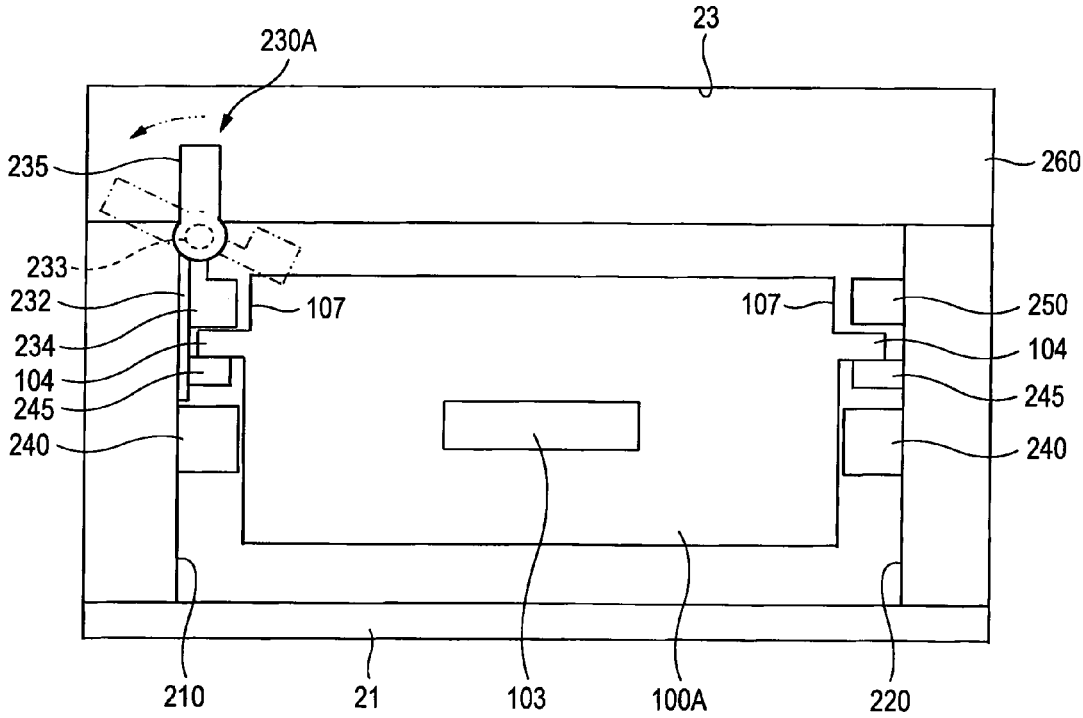
FIG. 12 is a front view of a color printer according to a sixth embodiment with a front cover opened.
Figure 13:
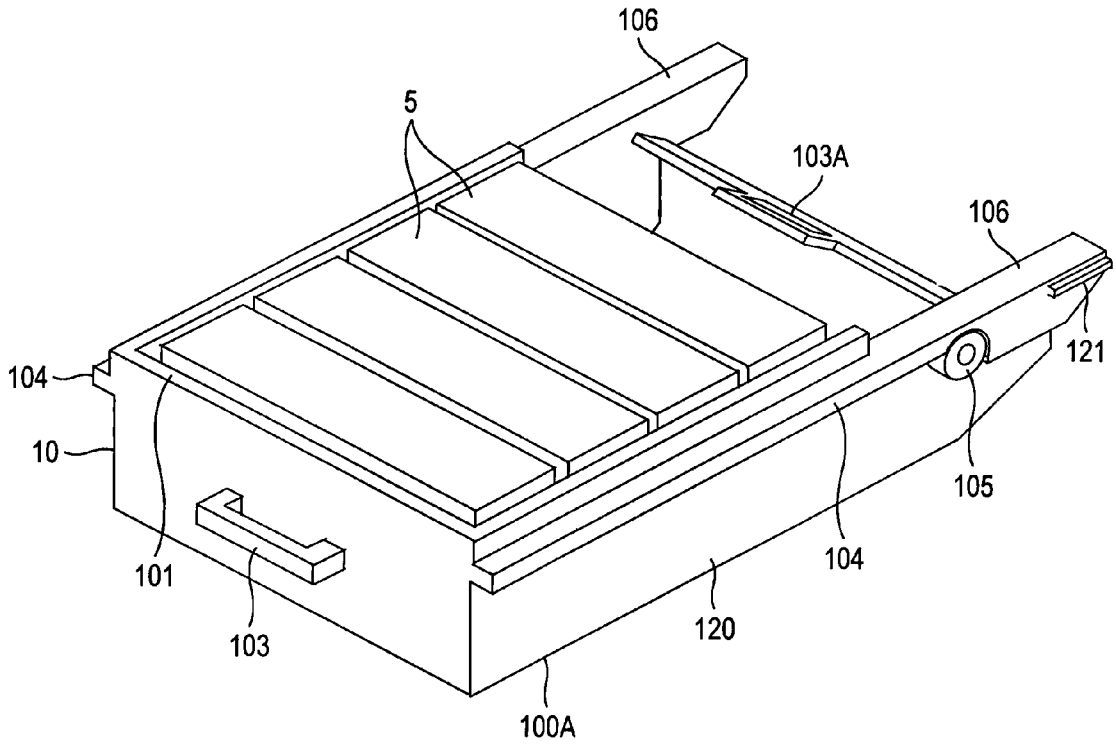
FIG. 13 is a perspective view of a supporting case according to the sixth embodiment.
Figure 14:
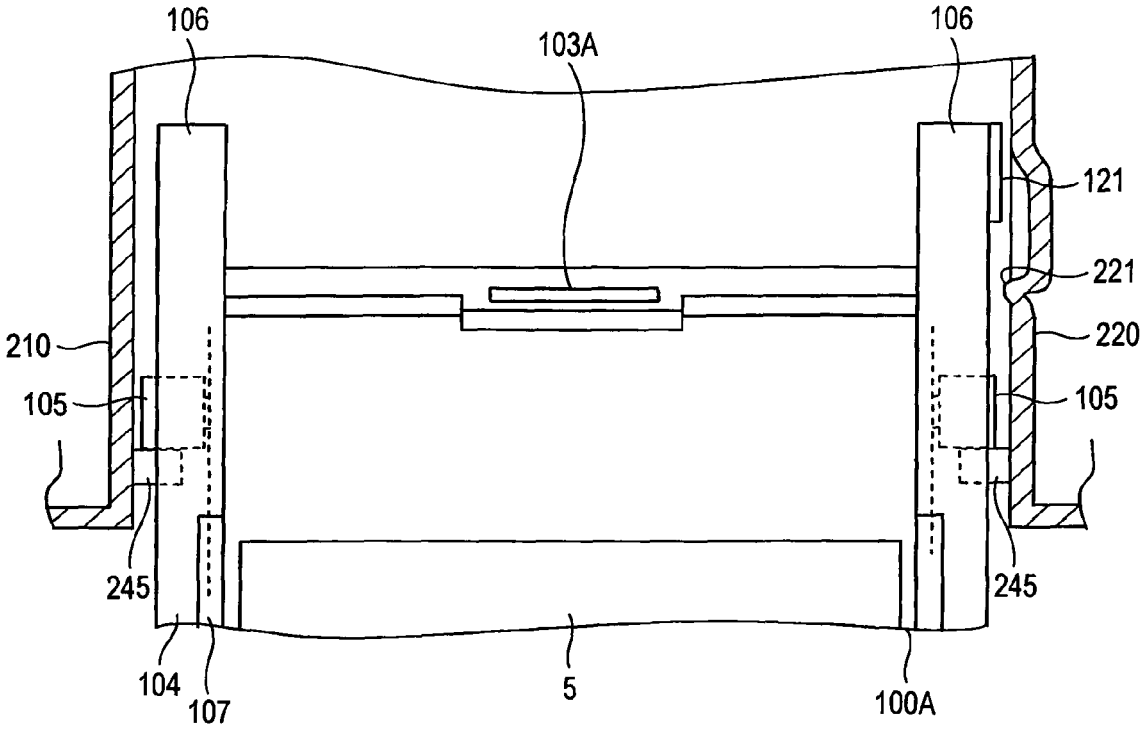
FIG. 14 is a cross-sectional view taken along the line X-X of FIG. 2, showing a state in which the supporting case according to the sixth embodiment is withdrawn.

When the supporting case 100A is at the accommodation position, as shown in FIG. 12, the locking portion 234 of the lock member 230A is positioned between the inner surface of the left frame 210 (the supporting plate 232) and the standing wall 107 of the supporting case 100A, and the lower end of the locking portion 234 faces the upper surface of the supporting protrusion 104 (i.e., the locking portion 234 is at the lock position). Therefore, the upward movement of the supporting protrusion 104 is restricted by the locking portion 234. As a result, even when the supporting case 100A is being withdrawn to the withdrawn position (see FIG. 14) and the guide roller 105 comes in contact with the stopper member 245, the lock state is maintained.

The locking portion 234 will not move to a position (release position) where it faces the upper surface of the supporting case 104) since the locking portion 234 is positioned between the left frame 210 and the standing wall 107 immediately until the supporting case 100A moves from the accommodation position to reach the withdrawn position. That is, the standing wall 107 functions as a prohibiting means for prohibiting the lock member 230A from moving from the lock position to the release position.

In the first embodiment, if the lock member is at the release position when the supporting case 100 is being withdrawn, there is a possibility that the supporting case 100 coming in contact with the stopper member may be removed and dropped without being held at the lock position when it is drawn with a strong force. However, in the present embodiment, since the lock member 230A is held at the lock position, it is possible to prevent such a possibility.

Figure 17:
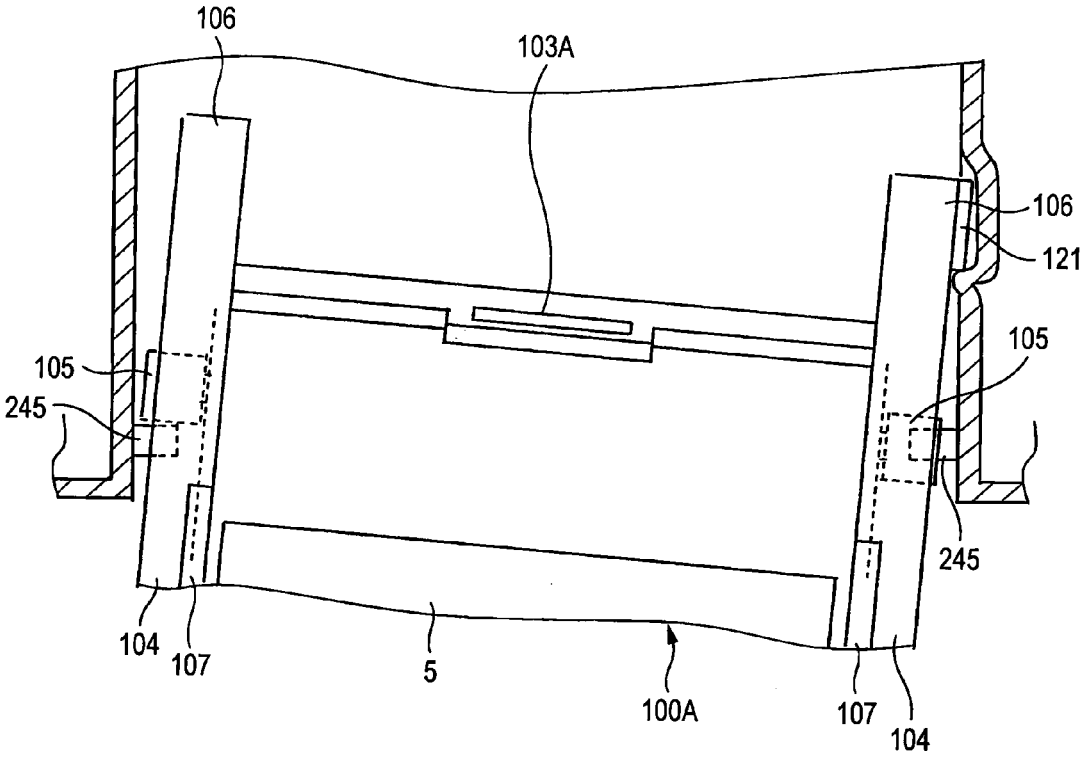
FIG. 17 is a diagram showing a state in which the supporting case according to the sixth embodiment rotates further from a withdrawing state.

When a force is further applied to the supporting case 100A in the withdrawal direction from the withdrawn position, similar to the first embodiment, as shown in FIG. 17, the supporting case 100A rotates, in the direction where the inward extension portion 106 moves closer to the right frame 220, about a rotation center at the abutting portion where the left guide roller 105 comes in contact with the stopper member 245, and the abutting portion 121 comes in contact with the abutted portion 221 of the right frame 220. As a result, the supporting case 100A is unable to be removed similar to the first embodiment.

When the supporting case 100A moves toward the withdrawn position, as shown in FIG. 15, the standing wall 107 is positioned closer to the front side than the lock member 230A. That is, the lock member 230A is able to pivot without coming in contact with the standing wall 107, and the locking portion 234 can be moved to a position (i.e., the release position) where the lower end of the locking portion 234 is separated from the upper surface of the supporting protrusion 104 as indicated by the chain line in FIG. 12. In this state, when the supporting case 100A which is at the withdrawn position is removed from the main body housing 2, similar to the first embodiment, the guide roller 105 is moved to surpass the stopper member 243 by operating the front and rear handles 103 and 103A in a state where the supporting case 100A is inclined with the front side raised.

When the removed supporting case 100A is mounted in the main body housing 2, in a state where the lock member 230A is moved to the release position and the supporting case 100A is inclined with the front side raised, the inward extension portions 106 are moved to be placed on the stopper members 245, and the supporting case 100A is pushed until the guide rollers 105 surpass the stopper members 245. After that, the supporting case 100A is returned to be substantially horizontal and the lock member 230A is operated to the lock position so that the supporting case 100A is further pushed into the main body housing 2.

Seventh Embodiment

Figure 18:
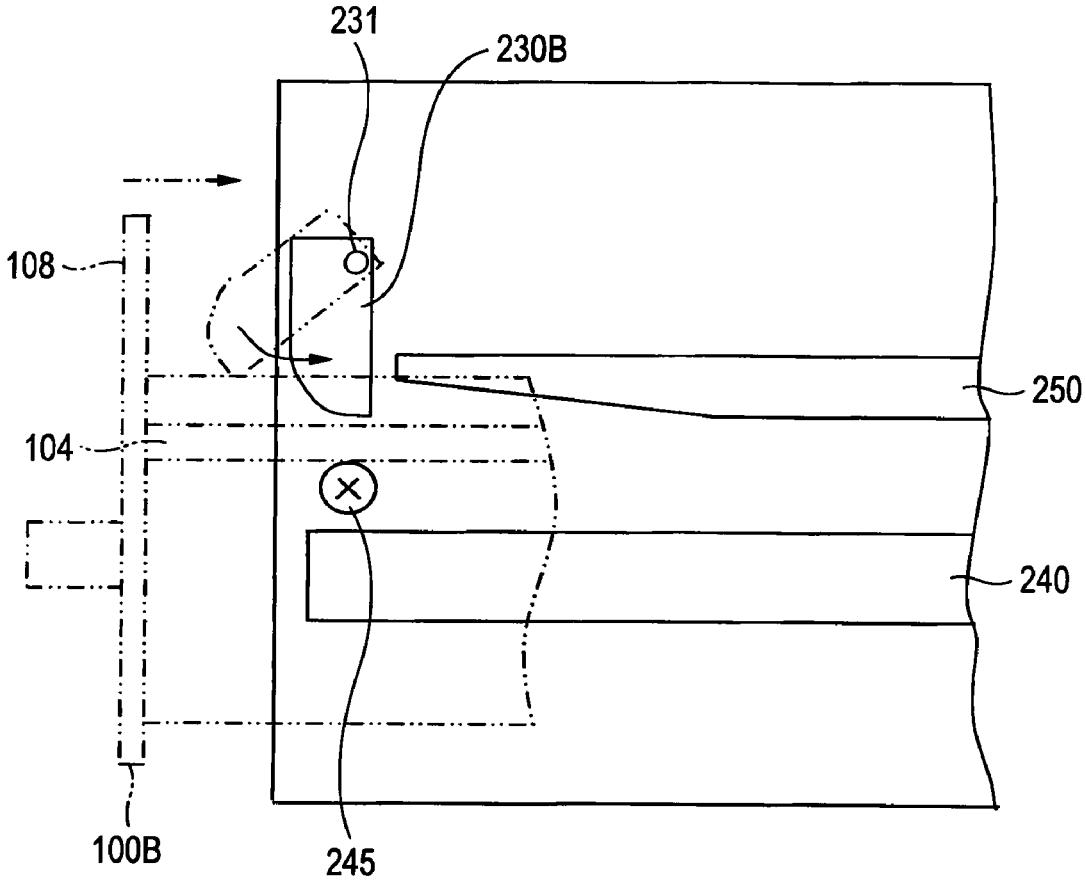
FIG. 18 is a side view of a left frame according to a seventh embodiment as viewed from an inner side.

FIG. 18 shows the seventh embodiment. The same structures as those of the first and second embodiments will be denoted by the same reference numerals, and description thereof will be omitted.

In the seventh embodiment, similar to the first embodiment, a lock member 230B is provided on a portion the left frame 210 near the opening 23 of the main body housing 2 so as to be pivotable back and forth about a parallel shaft 231. A supporting case 100B includes a wall 108 that extends leftward and upward from the front wall of the peripheral wall portion 101 so as to cover a side of the lock member 230B close to the opening 23. When the supporting case 100B is at the accommodation position, the wall 108 covers the side of the lock member 230B close to the opening 23 and functions as a prohibiting means for prohibiting a user from moving the lock member 230B which is at the lock position to the release position.

That is, when the supporting case 100B is at the accommodation position, if the user moves the lock member 230B which is at the lock position to the release position and withdraws the supporting case 100B, there is a possibility that the supporting case 100B coming in contact with the stopper member may be removed and dropped without being held at the lock position when it is drawn with a strong force. However, in the present embodiment, since the lock member 230A cannot be operated to the release position when the supporting case 100B is at the accommodation position, it is possible to prevent such a possibility.

More preferably, by designing the lock member 230B to enter into the moving trajectory of the wall 108 when the lock member 230B is at the release position, it is possible to move the lock member 230B which is at the release position to the lock position by pushing the wall 108 when the supporting case 100B moves from the withdrawn position to advance closer to the accommodation position.

The lock members 230A and 230B of the sixth and seventh embodiments may be provided on both of the left and right frames 210 and 220. Even when the restriction units (the abutting portion 121 and the abutted portion 221) are not provided, similar to the first embodiment, the supporting cases 100A and 100B can be held at the withdrawn position when they are being withdrawn.

Eighth Embodiment

Figure 19A:
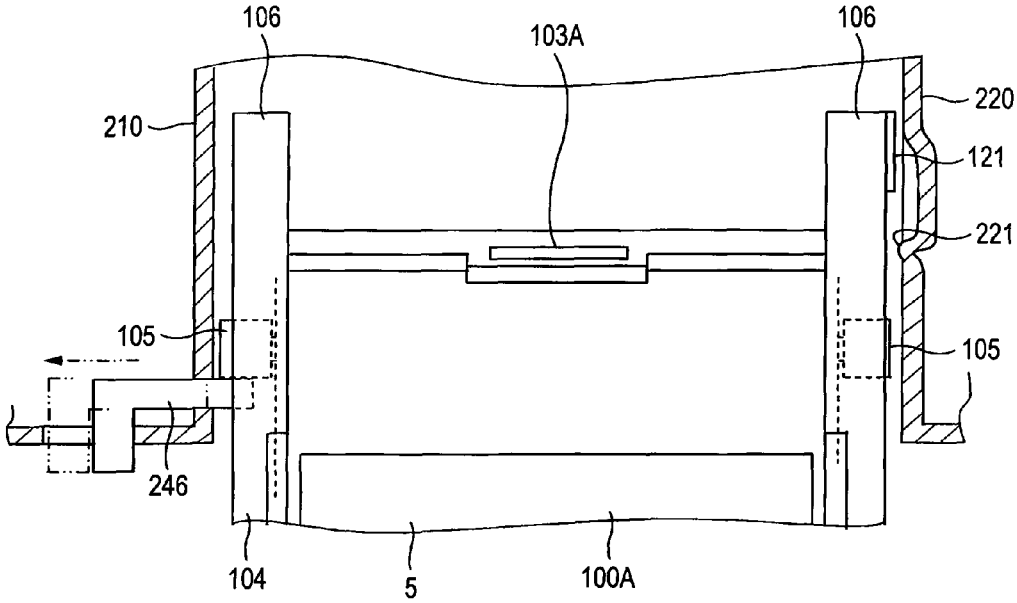
FIG. 19A is a cross-sectional view taken along the line X-X of FIG. 2 showing a state in which a supporting case according to an eighth embodiment is withdrawn.
Figure 19B:
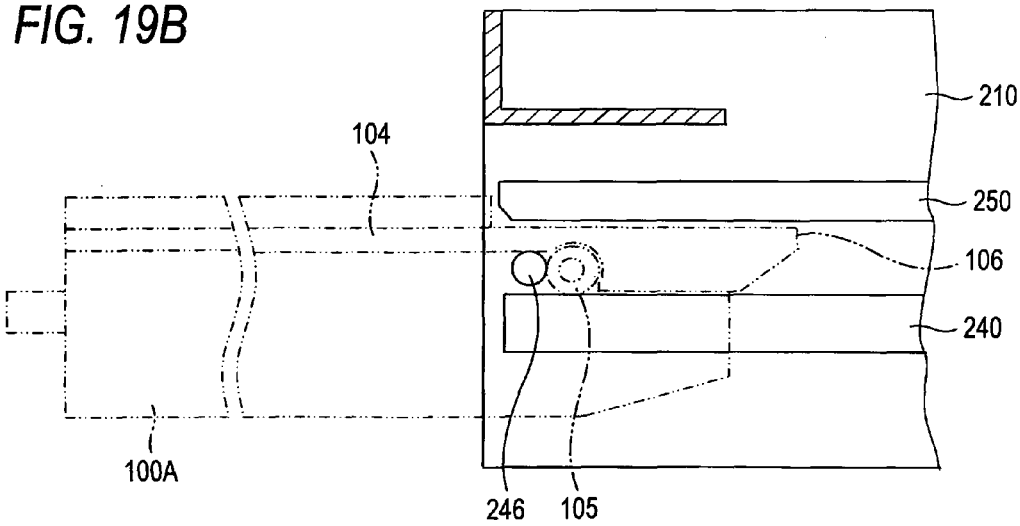
FIG. 19B is a side view of a left frame as viewed from an inner side.

FIGS. 19A and 19B show the eighth embodiment. The same structures as those of the first and second embodiments will be denoted by the same reference numerals, and description thereof will be omitted.

In the eighth embodiment, a stopper member 246 is provided so as to protrude into and retract from the moving path of the guide rollers 105 that move on the guide rails 240. More specifically, as shown in FIG. 19A, the stopper member 246 is supported on the left frame 210 to be movable in the left and right direction. The stopper member 246 is configured such that by operating an end thereof exposed to the front surface of the left frame 210, the other end protrudes into and retracts from a position located near the upper portion of the front end of the guide rail 240.

The engaging protrusion 250 is configured to hold the supporting case 100A to be substantially horizontal by coming in contact with the inward extension portion 106 when the supporting case 100A is at the withdrawn position similar to the above-described embodiments. In addition, as shown in FIG. 19B, the engaging protrusion 250 extends to be positioned on the upper side of the stopper member 246 which is at the protruded position. The distance between the engaging protrusion 250 and the stopper member 246 which is at the protruded position has such a dimension that allows the supporting protrusion 104 to pass through a space defined therebetween but does not allow both the supporting protrusion 104 and the guide roller 105 to pass through the space.

Therefore, in a state where the stopper member 246 is at the position where it protrudes into the moving path of the guide roller 105, when the supporting case 100A is being withdrawn to the withdrawn position, the guide roller 105 comes in contact with the stopper member 246 and is prevented from moving upward by the engaging protrusion 250, and accordingly, the supporting case 100A will be held at the withdrawn position. In this state, when the supporting case 100A is attempted to be further withdrawn in the withdrawal direction, the supporting case 100A rotates about the abutting portion where the guide roller 105 comes in contact with the stopper member 246. Accordingly, the abutting portion 121 comes in contact with the abutted portion 221, and the supporting case 100A cannot be withdrawn.

When the stopper member 246 is retracted from the moving path of the guide roller 105, since there is no structure that prevents the forward movement of the guide roller 105, the supporting case 100A can be removed from the main body housing 2 by withdrawing it forward.

That is, in the present embodiment, the stopper member 246 also serves as a lock member, and the protruded position corresponds to the lock position of the lock member and the retracted position corresponds to the release position of the lock member.

The stopper member 246 on the frame 220 where the restriction unit (the abutting portion 121 and the abutted portion 221) is present may be omitted, and the stopper member may be provided on at least the frame at the other side. Similarly to the other embodiments, the stopper member may be provided only on one side of the frame.

While the embodiments of the present invention have been described hereinabove, the present invention is not limited to the embodiments. As described below, changes can be made appropriately within the scope without departing from the gist of the present invention.

In the above-described embodiments, when the lock member 230 is provided on the side of the frame 210 (first frame), the lock member 230 may be provided on the side of any fixed frame such as a side wall of the main body housing (apparatus main body) close to the first frame. In addition, the lock member may be configured to freely advance and retract in a straight-line direction (For example, the lock member may be configured to protrude and recess so that the protruded position corresponds to the lock position and the recessed position corresponds to the release position).

The supporting member may be configured as a frame-shaped supporting case 100 without a bottom wall portion.

The left frame 210 (first frame) and the right frame 220 (second frame) may constitute the side wall of the main body housing (apparatus main body) as a part of the main body housing (apparatus main body). In addition, the positions of the lock member and the restriction unit may be reversed in the left and right direction from those described in the embodiments.

The supporting protrusion 104 may have the function of the guide rail, and the stopper member coming in sliding contact with the guide rail may have the function of the guide roller (contact member). Alternatively, the supporting protrusion 104 and the guide rail 240 may be configured to function in collaboration as the guide rail, and the stopper member 243 and the guide roller 105 (contact member) may be configured to respectively function as the stopper member and the contact member.

The present invention is not limited to a laser exposure-type color printer but may be applied to various types of image forming apparatuses such as a type where exposure is realized by light from an LED, an ink jet type, or a heat-sensitive type, or image forming devices such as a copier or a multi-function device. In addition, the supporting member is not limited to one that detachably supports the whole body of an electrostatic process cartridge but may be one that detachably supports only a toner box with a photosensitive drum left on the side of the supporting member, and in the case of an ink jet type, an ink cartridge or other expendables such as, for example, paper and a transfer unit including a transport belt.

What is claimed is:

1. An image forming apparatus comprising:

an apparatus main body;

a frame-shaped supporting member that has a first side wall and a second side wall that is opposed to the first side wall, the supporting member configured to be movable between an accommodation position where the supporting member is accommodated in the apparatus main body and a withdrawn position where the supporting member is withdrawn from the apparatus main body, the supporting member configured to be removable from the apparatus main body by being withdrawn further from the withdrawn position;

a first frame that is opposed to the first side wall and a second frame that is opposed to the second side wall, the first frame and the second frame disposed opposite to each other so as to accommodate the supporting member which is in the accommodation position in the apparatus main body, the first frame and the second frame supporting the supporting member so as to be movable between the accommodation position and the withdrawn position;

a lock member that is configured to be movable between a lock position at which the first side wall of the supporting member is restricted and locked at the withdrawn position and a release position at which the lock member is released to allow the supporting member to be removed; and a restriction unit that is provided on the second side wall and the second frame, the restriction unit configured to restrict rotation of the supporting member by making contact with the supporting member when the supporting member, which is locked into the withdrawn position, rotates to the first frame side of the apparatus main body.

2. The image forming apparatus according to claim 1, wherein, the first frame includes a stopper member that restricts the supporting member from moving in an extending direction of a direction of withdrawal when the supporting member is being withdrawn to the withdrawn position, and the restriction unit restricts the supporting member from rotating in the extending direction from the apparatus main body about a position near an abutting portion with the stopper member when the stopper member receives a force that moves the supporting member in the extending direction in a state where the movement of the supporting member is restricted by the stopper member.

3. The image forming apparatus according to claim 2, wherein, a distance between the second side wall and the second frame has a dimension that allows the supporting member to rotate about the position near the abutting portion with the stopper member when the supporting member receives the force that moves the supporting member in the extending direction in the state where the movement of the supporting member is restricted by the stopper member, the second side wall includes a portion that extends more toward an inner side of the apparatus main body than a position where the second side wall faces the stopper member in the state, and the restriction unit includes an abutting portion that is provided near a front end of the portion extending toward the inner side of the second side wall and an abutted portion that is provided on the second frame that makes contact with the portion of the second side wall.

4. The image forming apparatus according to claim 3, wherein, a distance from approximately a rotation center of the supporting member to the abutting portion is larger than a distance from the rotation center to the abutted portion, and a distance from the first frame to the abutted portion is equal to or larger than a distance from the first side wall to the abutting portion.

5. The image forming apparatus according to claim 2, wherein, the supporting member includes a supporting protrusion that protrudes like a flange at least from the first side wall to a position facing the stopper member, and the lock member is configured to advance closer to a surface of the supporting protrusion opposite to the stopper member when the lock member is at the lock position to prevent the contact member from surpassing the stopper member and allow the contact member to move over the stopper member in the release position with a space larger than that in the advanced state to enable the supporting member to be removed from the apparatus main body.

6. The image forming apparatus according to claim 5, further comprising, a prohibiting unit for prohibiting the lock member from moving from the lock position to the release position when the supporting member is at the accommodation position, wherein, when the supporting member is at the withdrawn position, the lock member is movable to the release position.

7. The image forming apparatus according to claim 6, wherein, the supporting member includes a wall that is provided on a side of the supporting protrusion opposite to the stopper member so as to stand substantially in parallel with the first side wall, the lock member is movable between the lock position in which the lock member faces the supporting protrusion and the release position where the lock member is positioned closer to the standing wall than when the lock member is positioned at the position in which the lock member faces the supporting protrusion, the prohibiting unit is the standing wall, and when the supporting member is at the accommodation position, the lock member is positioned to face the standing wall, so that the lock member is prohibited by the standing wall from moving toward a side of the standing wall, and when the supporting member is at the withdrawn position, the lock member is positioned more to the inner side of the apparatus main body than the standing wall and is movable to the release position.

8. The image forming apparatus according to claim 7, wherein, the lock member is pivotable about an axial line that is substantially parallel to the withdrawal direction of the supporting member.

9. The image forming apparatus according to claim 5, wherein, the supporting member has a portion that extends more toward an inner side of the apparatus main body than the stopper member when the supporting member is at the withdrawn position, and the first frame and the second frame include an engaging protrusion that makes contact with the extended portion of the supporting member so that the supporting member is held to be substantially horizontal against weight thereof when the supporting member is close to the withdrawn position and the lock member is in the releasable state.

10. The image forming apparatus according to claim 5, wherein, the lock member is provided on a portion of the first frame near an opening through which the supporting member of the apparatus main body is being withdrawn, and the prohibiting unit is a wall which is provided on the supporting member so as to cover a side of the lock member close to the opening when the supporting member is at the accommodation position.

11. The image forming apparatus according to claim 10, wherein, the wall of the supporting member causes the lock member which is at the release position to move to the lock position when the supporting member is moved from the withdrawn position to the accommodation position.

12. The image forming apparatus according to claim 2, wherein, the first frame and the second frame each have a guide rail that extends in the withdrawal direction so as to support the supporting member to be movable in the withdrawal direction, and the first side wall and the second side wall each have a contact member that makes contact with each of the guide rails to be movable in the withdrawal direction, the supporting member has a supporting protrusion that protrudes like a flange at least from the first side wall to a position facing the stopper member, and a portion that extends more toward an inner side of the apparatus main body beyond the stopper member when the supporting member is at the withdrawn position, the first frame has an engaging protrusion that makes contact with the extended portion of the supporting member so that the supporting member is held to be substantially horizontal against weight thereof when the supporting member is close to the withdrawn position, and the engaging protrusion is provided at a position facing the stopper member with the supporting protrusion disposed therebetween, and the stopper member also serves as the lock member, and is movable between a protruded position where the stopper member protrudes toward a moving path of the contact portion to restrict the supporting member at the withdrawn position and a retracted position where the stopper member is retracted from the moving path to enable the supporting member to be removed.

13. The image forming apparatus according to claim 1, wherein, a guide rail that extends in a direction of withdrawal and a contact member that makes contact with the guide rail so as to be movable in the withdrawal direction are provided between the first side wall and the first frame and between the second side wall and the second frame, the guide rail and the contact member configured to support the supporting member to be movable in the withdrawal direction, the first frame includes a stopper member that restricts the supporting member from moving in an extending direction of the withdrawal direction when the supporting member is being withdrawn to the withdrawn position, and the lock member is configured to hold the guide rail and the contact member approximately at a position where they oppose each other in a state where the movement of the supporting member which is at the lock position is restricted by the stopper member and allow the guide rail and the contact member which is at the release position to be advanced and retracted relative to each other.

14. The image forming apparatus according to claim 13, wherein, the contact member is configured to make contact with the stopper member when the supporting member is being withdrawn to the withdrawn position, and the supporting member is configured to rotate in the extending direction about a position near an abutting portion thereof.

15. The image forming apparatus according to claim 13, wherein, the first frame and the second frame oppose each other in a substantially horizontal direction with a gap therebetween, the supporting member is configured to be movable in a substantially horizontal direction between the accommodation position and the withdrawn position, the supporting member has a portion that extends more toward an inner side of the apparatus main body than the stopper member when the supporting member is at the withdrawn position, and the first frame and the second frame include an engaging protrusion that makes contact with the extended portion of the supporting member so that the supporting member is held to be substantially horizontal against weight thereof when the supporting member is close to the withdrawn position.

16. The image forming apparatus according to claim 15, wherein, the first frame and the second frame have the respective guide rails which extend in a substantially horizontal direction and have the respective engaging protrusions which are spaced upward from at least an end of each of the guide rails close to the stopper member, the supporting member has the contact member that makes contact with the guide rails so as to be movable in a state of being mounted on the guide rails, and a distance between the engaging protrusion and the stopper member has a dimension that allows the contact member to pass therebetween when the supporting member is removed from the withdrawn position to the outside of the apparatus main body.

17. The image forming apparatus according to claim 15, wherein, the restriction unit includes an abutting portion that is provided near a front end of the extended portion of the supporting member and an abutted portion that is provided on the second frame that makes contact with the extended portion.

18. The image forming apparatus according to claim 1, wherein, the supporting member is accommodated to allow expendables in the image forming apparatus to be exchanged and is exposed to allow expendables to be exchanged from the apparatus main body at the withdrawn position.

19. An image forming apparatus comprising:

an apparatus main body;

a frame-shaped supporting member that is configured to be movable between an accommodation position in the apparatus main body and a withdrawn position withdrawn from the apparatus main body and be removable from the apparatus main body by being withdrawn further from the withdrawn position, the supporting member having a pair of side walls opposing each other so as to extend in a direction of withdrawal;

a pair of frames that is arranged to oppose the side walls so as to sandwich the supporting member which is in the accommodation position in the apparatus main body and is configured to support the supporting member to be movable between the accommodation position and the withdrawn position;

a stopper member that is provided on either one of the frames so as to restrict the supporting member from moving in an extending direction of the withdrawal direction when the supporting member is being withdrawn further from the withdrawn position;

a lock member that is movable between a lock position restricting the supporting member at the withdrawn position so that the lock member is unable to be removed in collaboration with the stopper member and a release position in which the supporting member is allowed to be removed; and a prohibiting unit for prohibiting the lock member from moving from the lock position to the release position when the supporting member is at the accommodation position, wherein, the lock member is movable toward the release position regardless of the prohibiting unit when the supporting member is at the withdrawn position.

20. The image forming apparatus according to claim 19, wherein, the frames each include a guide rail that supports the supporting member to be movable in the withdrawal direction, the side walls facing the frames each include a contact member that makes contact with the guide rail so as to be movable in the withdrawal direction and a supporting protrusion that extends like a flange from the side wall on a side of the stopper member opposite to the guide rail to a position where the supporting protrusion faces the stopper member, the lock member is provided at a position near the stopper member with the supporting protrusion disposed therebetween when the lock member is at the lock position, and the lock member is configured to advance closer to the supporting protrusion when the lock member is at the lock position to prevent the contact member from surpassing the stopper member and allow the contact member to move over the stopper member in the release position with a space larger than that in the advanced state to enable the supporting member to be removed from the apparatus main body.

21. The image forming apparatus according to claim 20, wherein, the pair of frames opposes each other in a substantially horizontal direction with a space therebetween, the supporting member is movable in a substantially horizontal direction between the accommodation position and the withdrawn position, the supporting member has a portion that extends more toward an inner side of the apparatus main body than the stopper member when the supporting member is at the withdrawn position, the pair of frames includes an engaging protrusion that makes contact with the extended portion of the supporting member so that the supporting member is held to be substantially horizontal against weight thereof when the supporting member is close to the withdrawn position, and a distance between the engaging protrusion and the stopper member has a dimension that allows the contact member to pass therebetween when the supporting member is removed from the withdrawn position to the outside of the apparatus main body.

22. The image forming apparatus according to claim 21, wherein, the lock member is pivotable about an axial line that is substantially parallel to the withdrawal direction of the supporting member.

23. The image forming apparatus according to claim 19, wherein, the supporting member has a supporting protrusion that protrudes like a flange at least from the first side wall to a position where the supporting protrusion faces the stopper member, and a wall that is provided on a side of the supporting protrusion opposite to the stopper member so as to stand substantially in parallel with the first side wall, the lock member is movable between the lock position where the lock member faces the supporting protrusion and the release position in which the lock member is positioned closer to the standing wall than when the lock member is positioned at the position facing the supporting protrusion, the prohibiting unit is the standing wall, and when the supporting member is at the accommodation position, the lock member is positioned at a position facing the standing wall, so that the lock member is prohibited by the standing wall from moving toward a side of the standing wall, and when the supporting member is at the withdrawn position, the lock member is positioned more to the inner side of the apparatus main body than the standing wall and is movable to the release position.

24. The image forming apparatus according to claim 19, wherein, the lock member is provided on a portion of the first frame near an opening through which the supporting member of the apparatus main body is being withdrawn, and the prohibiting unit is a wall which is provided on the supporting member so as to cover a side of the lock member close to the opening when the supporting member is at the accommodation position.

25. The image forming apparatus according to claim 24, wherein, the wall of the supporting member causes the lock member which is at the release position to move to the lock position when the supporting member is moved from the withdrawn position to the accommodation position.

26. The image forming apparatus according to claim 19, wherein, the supporting member is accommodated to allow expendables in the image forming apparatus to be exchanged and is exposed to allow expendables to be exchanged from the apparatus main body at the withdrawn position.

* * * * *